US012490787B2

(12) United States Patent
Li

(10) Patent No.: US 12,490,787 B2
(45) Date of Patent: Dec. 9, 2025

(54) SELECTIVELY PIVOTABLE FACE SHIELD DEVICE, SYSTEM, AND METHOD FOR USE WITH USER HEADGEAR AND FOR PHYSICALLY BLOCKING NOXIOUS AIRBORNE SUBSTANCES

(71) Applicant: 12354870 CANADA INC., North York (CA)

(72) Inventor: Ka Shun Edmund Li, North York (CA)

(73) Assignee: 12354870 Canada Inc., Toronto (CA)

( * ) Notice: Subject to any disclaimer, the term of this patent is extended or adjusted under 35 U.S.C. 154(b) by 1042 days.

(21) Appl. No.: 17/536,847

(22) Filed: Nov. 29, 2021

(65) Prior Publication Data

US 2022/0167695 A1 Jun. 2, 2022

Related U.S. Application Data

(60) Provisional application No. 63/118,823, filed on Nov. 27, 2020.

(51) Int. Cl.
*A41D 13/11* (2006.01)
*A42B 1/24* (2021.01)

(52) U.S. Cl.
CPC ..... *A41D 13/1184* (2013.01); *A41D 13/1161* (2013.01); *A42B 1/24* (2013.01)

(58) Field of Classification Search
CPC .. A41D 13/1184; A41D 13/1161; A42B 1/24; A42B 1/018
See application file for complete search history.

(56) References Cited

U.S. PATENT DOCUMENTS 5,647,060 A * 7/1997 Lee ..... A61F 9/027 128/857

FOREIGN PATENT DOCUMENTS

WO WO-2023060355 A1 * 4/2023 ..... A41D 13/1161

* cited by examiner

*Primary Examiner* — Kendra D Carter
*Assistant Examiner* — Maap Ellabib
(74) *Attorney, Agent, or Firm* — HOLBECHE LAW; Kevin Edward Holbeche

(57) ABSTRACT

A face shield includes a clear front portion, stop members, and side portions with pivot holes. A device includes clip members with pivot knobs that extend outward through the pivot holes. The shield pivotably engages the clip members. The clip members are securable to user headgear. The shield can be pivoted between open and closed configurations. Although it is gravity-biased towards the closed configuration, the shield can be pivoted past the stop members into the open configuration. In the open configuration, the stop members withstand the aforesaid gravity-biasing and keep the shield in the open configuration. The stop members can be resiliently deformed to permit pivoting of the shield from the open configuration towards the closed configuration. The shield is formed from a flat plastic sheet, with notches that engage mating tongues to keep it in a folded configuration.

16 Claims, 18 Drawing Sheets

SELECTIVELY PIVOTABLE FACE SHIELD DEVICE, SYSTEM, AND METHOD FOR USE WITH USER HEADGEAR AND FOR PHYSICALLY BLOCKING NOXIOUS AIRBORNE SUBSTANCES

FIELD OF THE INVENTION

The present invention relates generally to blocking airborne substances and, more particularly, to a selectively pivotable face shield device, system, and method for use with user headgear and for physically blocking noxious airborne substances.

BACKGROUND OF THE INVENTION

In these COVID-19 times and in the future, there may be a need and/or desire for an improved barrier screen. Face shields and like devices may be known in the prior art to help protect wearers' faces and others proximal to them. These devices may have created physical barriers against airborne substances.

Prior art clear face shields of this type may have been held in place over a user's face, including over the user's mouth and nose. Some such prior art face shields may have been adapted to clip onto a hat that was also worn by the user. Similarly, some prior art face shields may have been integrally provided with eye glasses, and/or adapted to be fastened onto eye glasses. Many prior art face shields, however, may be problematic and/or suffer from being held in a static position, with the shield unable to move once fastened to the user's hat or eye glasses. Prior art face shields of either type—i.e., particularly adapted for use with hats or eye glasses—may not have been particularly well adapted, or adapted whatsoever, for use with the other. Prior art face shields may not have been transferable between eye glasses and/or hats, or may not have been adapted for use on multiple items, such as, for example, being adapted for use with both eye glasses and hats.

Other prior face shields may have been connected to a headband and/or been adapted to flip up and/or turn into a visor. Some such prior art face shields may have been cost-prohibitive for many consumers. Prior art headband-mounted face shields, adapted to be worn across the forehead, may have been uncomfortable, e.g., for users with oily and/or sensitive skin.

Also, prior art face shields may be problematic and/or suffer from having an open bottom portion, which may allow droplets to escape straight down.

What may be needed or desired is a selectively pivotable face shield device, system, and method for use with user headgear and for physically blocking noxious airborne substances.

It is an objection of the invention to provide a face shield device, system, and/or method.

It may be an object according to one aspect of the invention to provide a selectively pivotable face shield device, system, and method for use with user headgear.

It may be an object according to one aspect of the invention to provide a device, system, and/or method for physically blocking noxious airborne substances.

It may be an object according to one aspect of the invention to provide a device, system, and/or method which may help to reduce, minimize, and/or avoid risk of harm associated with noxious airborne substances.

It may be an object according to one aspect of the invention to provide a face shield device, system, and/or method which: (a) enables and/or facilitates more comfortable breathing by users than prior art face masks; (b) enables and/or facilitates users to see each other's smiles; (c) provides eye protection; (d) doesn't fog up glasses; (e) fits right onto a cap; (f) can be easily put on and/or taken off without touching a user touching his or her face; (g) can be flipped up; (h) can be easily and/or readily cleaned; and/or (i) can be reused.

It may be an object according to one aspect of the invention to provide a face shield device, system, and/or method wherein a lower part of a face shield is preferably bent and/or curved towards the user's chin, and/or wherein the face shield reduces chances and/or distance of moisture droplet escape and/or expulsion.

It may be an object according to one aspect of the invention to provide a face shield device, system, and/or method which provides a barrier between the user and the environment, for example, to prevent droplets from being ingested, for gardening, and/or for wind protection.

It is an object of the present invention to obviate or mitigate one or more disadvantages and/or shortcomings associated with the prior art, to meet or provide for one or more needs and/or advantages, and/or to achieve one or more objects of the invention—one or more of which may preferably be readily appreciable by and/or suggested to those skilled in the art in view of the teachings and/or disclosures hereof.

SUMMARY OF THE INVENTION

According to the invention, there is disclosed a selectively pivotable face shield device for use with user headgear and/or for physically blocking noxious airborne substances. The device may preferably include a face shield member and/or clip members. The face shield member may preferably have a front shield portion and/or side shield portions. It may preferably be shaped to define stop members constructed of a resiliently deformable material. The front shield portion may preferably be constructed of a substantially optically clear material. Each of the side shield portions may preferably be shaped to define a pivot hole therethrough. Each of the clip members may preferably have a clipping portion and a pivot knob member that securely engages and extends outward from the clipping portion. The pivot knob member of each of the clip members may preferably extend, in secure and/or selectively pivotable engagement, through the pivot hole in a respective one of the side shield portions. Preferably as such, the face shield member may preferably securely and/or pivotably engage the clip members. The clipping portion of each of the clip members may preferably be selectively securable, in use, to the headgear. Preferably as such, the face shield member may preferably be pivotably secured to the headgear, preferably for selective pivoting between an open configuration and a closed configuration that may preferably physically block noxious airborne substances. The face shield member may preferably be gravity-biased towards the closed configuration. The face shield member may preferably be selectively pivotable against the aforesaid gravity-biasing away from the closed configuration, past the stop members, and/or into the open configuration. In the open configuration, the shaping of the stop members from the resiliently deformable material may preferably be sufficient to withstand the aforesaid gravity-biasing. Preferably as such, the stop members may preferably then maintain the face shield member in the open configuration. Selective resilient deformation of the stop members may preferably permit pivoting of the face shield member away from the open configuration and/or towards the closed configuration.

According to an aspect of one preferred embodiment, the face shield member may preferably, but need not necessarily, be further shaped to define a wide hole and/or a raised hole through each respective one of the side shield portions. Each of the stop members may preferably, but need not necessarily, include a stop channel that may preferably, but need not necessarily, also be shaped through the aforesaid respective one of the side shield portions, and/or extend from the wide hole to the raised hole. The stop channel may preferably, but need not necessarily, have a narrowing as it extends from the wide hole to the raised hole. Each of the clip members may preferably, but need not necessarily, have a sliding knob member that securely engages and/or extends outward from the clipping portion. The sliding knob member may preferably, but need not necessarily, extend through the wide hole, the stop channel, and/or the raised hole in secure sliding engagement. Preferably in the closed configuration, the sliding knob member may preferably, but need not necessarily, rest in the wide hole. Preferably when the face shield member may be selectively pivoted away from the closed configuration, the sliding knob member may preferably, but need not necessarily, slide through the stop channel and/or into the raised hole in the open configuration. Preferably in the open configuration, the aforesaid narrowing of the stop channel may preferably, but need not necessarily, obstruct the sliding knob member and/or keeps the sliding knob member in the raised hole. Selective resilient deformation of the stop channel may preferably, but need not necessarily, permit sliding of the sliding knob member away from the raised hole, through the stop channel, and/or towards the wide hole.

According to an aspect of one preferred embodiment, the face shield member may preferably, but need not necessarily, have a top edge portion. The stop members may preferably, but need not necessarily, include a top stop portion along the top edge portion, preferably, adjacent to one of the side shield portions. Preferably in the open configuration, the top stop portion may preferably, but need not necessarily, engage an underside of the headgear and/or maintain the face shield member in the open configuration. Selective resilient deformation of the top stop portion may preferably, but need not necessarily, permit removal of the top stop portion from the headgear and, preferably, then pivoting of the face shield member away from the open configuration and/or towards the closed configuration.

According to an aspect of one preferred embodiment, the clipping portion of each of the clip members may preferably, but need not necessarily, be selectively removable from the user headgear.

According to an aspect of one preferred embodiment, the clipping portion of each of the clip members may preferably, but need not necessarily, have an outer arm portion, an inner arm portion, and/or a bottom portion that securely engages the outer arm portion and/or the inner arm portion. Preferably in use, the headgear may preferably, but need not necessarily, be secured between the outer arm portion and the inner arm portion. The pivot knob member may preferably, but need not necessarily, securely engage and/or extend outward from the outer arm portion.

According to an aspect of one preferred embodiment, the inner arm portion may preferably, but need not necessarily, have a bulging tip portion. The outer arm portion may preferably, but need not necessarily, have an inner surface. Preferably in use, the headgear may preferably, but need not necessarily, be secured between the inner surface and the bulging tip portion. The outer arm portion may preferably, but need not necessarily, have an exterior facing portion that is angled relative to the inner surface such that, in use, the face shield member may preferably, but need not necessarily, hang substantially parallel to the user's face.

According to an aspect of one preferred embodiment, the face shield member may preferably, but need not necessarily, have an enclosing bottom shield portion. The enclosing bottom shield portion may preferably, but need not necessarily, extend rearward from the front shield portion and/or under the user's chin.

According to an aspect of one preferred embodiment, the bottom shield portion may preferably, but need not necessarily, include a bottom filter member that permits passage of air therethrough and/or physically blocks noxious airborne substances.

According to an aspect of one preferred embodiment, the device may preferably, but need not necessarily, include one or more filter skirt inserts. The filter skirt inserts may preferably, but need not necessarily, securely engage the face shield member, and/or be adapted to extend between the face shield member and the user, preferably while permitting passage of air therethrough and/or physically blocking noxious airborne substances.

According to an aspect of one preferred embodiment, the substantially optically clear material of the front shield portion may preferably, but need not necessarily, provide a substantially unobstructed frontal view of the user.

According to an aspect of one preferred embodiment, the face shield member may preferably, but need not necessarily, be formed from a substantially flat plastic sheet.

According to an aspect of one preferred embodiment, the sheet may preferably, but need not necessarily, be folded into a folded configuration to form the face shield member.

According to an aspect of one preferred embodiment, the sheet may preferably, but need not necessarily, be shaped to define one or more fold notches and mating tongues. The fold notches may preferably, but need not necessarily, securely engage the mating tongues, preferably to maintain the face shield member in the folded configuration.

According to an aspect of one preferred embodiment, the device may preferably, but need not necessarily, be adapted for use with a baseball cap, a visor-style hat, and/or eyeglass frames as the user headgear. Each aforesaid clipping portion may preferably, but need not necessarily, be secured to a brim of the baseball cap and/or of the visor-style hat, and/or to an arm of the eyeglass frames.

According to the invention, there is also disclosed a selectively pivotable face shield system for physically blocking noxious airborne substances. The system may preferably include headgear, a face shield member, and/or clip members. The headgear may preferably be adapted to be worn on a user's head. The face shield member may preferably have a front shield portion and side shield portions, and/or be shaped to define stop members constructed of a resiliently deformable material. The front shield portion may preferably be constructed of a substantially optically clear material. Each of the side shield portions may preferably be shaped to define a pivot hole therethrough. Each of the clip members may preferably have a clipping portion and a pivot knob member that securely engages and extends outward from the clipping portion. The pivot knob member of each of the clip members may preferably extend, in secure and/or selectively pivotable engagement, through the pivot hole in a respective one of the side shield portions. Preferably as such, the face shield member may preferably securely and/or pivotably engage the clip members. Preferably in use, the clipping portion of each of the clip members may preferably be secured to the headgear. Preferably as such, the face shield member may preferably be pivotably secured to the headgear for selective pivoting between an open configuration and a closed configuration that may preferably physically block noxious airborne substances. The face shield member may preferably be gravity-biased towards the closed configuration. The face shield member may preferably be selectively pivotable against the aforesaid gravity-biasing away from the closed configuration, past the stop members, and/or into the open configuration. Preferably in the open configuration, the shaping of the stop members from the resiliently deformable material may preferably be sufficient to withstand the aforesaid gravity-biasing. Preferably as such, the stop members may preferably then maintain the face shield member in the open configuration. Selective resilient deformation of the stop members may preferably permit pivoting of the face shield member away from the open configuration and/or towards the closed configuration.

According to an aspect of one preferred embodiment, the headgear may preferably, but need not necessarily, have two arm portions. Each aforesaid clipping portion may preferably, but need not necessarily, be secured to a respective one of the arm portions.

According to an aspect of one preferred embodiment, the headgear may preferably, but need not necessarily, include two earpiece portions adapted to be worn on the user's ears. Each of the arm portions may preferably, but need not necessarily, securely engage and/or extend forward from a respective one of the earpiece portions.

According to the invention, there is also disclosed a method of forming a face shield member from a substantially optically clear, substantially flat, and/or deformable plastic sheet, for use in physically blocking noxious airborne substances. The method may preferably include a step of (a) cutting the plastic sheet, preferably to define one or more fold notches and/or mating tongues. The method may preferably include a step of (b) folding the plastic sheet into a folded configuration, preferably to form the face shield member. Preferably as such, the face shield member may preferably have a front shield portion, side shield portions, and/or an enclosing bottom shield portion. The enclosing bottom portion may preferably extend rearward from the front shield portion. The fold notches may preferably securely engage the mating tongues, preferably to maintain the face shield member in the folded configuration. The method may preferably include a step of (c) securely attaching the face shield member to headgear, preferably by one or more clip members. The headgear may preferably be adapted to be worn by a user. Accordingly, in use, the enclosing bottom shield portion may preferably extend under the user's chin, and/or the face shield member may preferably physically block noxious airborne substances.

According to the invention, there is also disclosed a selectively pivotable face shield device, system, and/or method for use with user headgear and/or for physically blocking noxious airborne substances.

According to an aspect of one preferred embodiment, the device, system, and/or method includes a face shield member that may preferably, but need not necessarily, be adapted to flip up easily when word by a user, preferably, for example, readily enabling the user to take a deep breath, and/or have a drink, if, when, and/or as may be required and/or desired.

According to an aspect of one preferred embodiment, the face shield member may preferably, but need not necessarily, be provided with an enclosing bottom portion that is preferably adapted to fully and/or partially enclose the user's chin. The enclosing bottom portion may preferably, but need not necessarily, help to reduce chances and/or tendency of any moisture droplets escaping and/or going straight down below the face shield member.

According to an aspect of one preferred embodiment, the face shield member may preferably, but need not necessarily, be adapted to readily and/or easily attach and/or clip onto a wide variety of user headgear, such as, for example, a hat brim, a visor, and/or eyeglass frames.

According to an aspect of one preferred embodiment, the face shield member may preferably, but need not necessarily, be provided with a filter portion, for example, on a back portion of the face shield member.

According to an aspect of one preferred embodiment, the face shield member may preferably, but need not necessarily, be constructed of a substantially optically clear and/or see-through material, and/or it may provide an unobstructed frontal view of the user (including the user's mouth and nose). Preferably, when the user is wearing the face shield member in a lowered configuration, the optically clear/see-through construction of the face shield member may preferably, but need not necessarily, cover at least part of the user's face. It may preferably, but need not necessarily, prevent, reduce, and/or minimize migration of airborne substances moving towards and/or away from the user.

According to an aspect of one preferred embodiment, the face shield member may preferably, but need not necessarily, be provided in a variety of different sizes, and/or accommodates a variety of users in different sizes.

The face shield member may preferably, but need not necessarily, be worn by the user. The face shield member may preferably, but need not necessarily, physically shield to help avoid, reduce, and/or minimize transmission of infectious biological substances.

According to an aspect of one preferred embodiment, the face shield member may preferably, but need not necessarily, be protective and/or selectively removable by the user.

Other advantages, features and characteristics of the present invention, as well as methods of operation and functions of the related elements of the structure, and the combination of parts and economies of manufacture, will become more apparent upon consideration of the following detailed description with reference to the figures which accompany this application.

BRIEF DESCRIPTION OF THE DRAWINGS

The novel features which are believed to be characteristic of the present invention, and related devices, systems, and methods according to the present invention, as to their structure, organization, use and method of operation, together with further objectives and advantages thereof, may be better understood from the figures which accompany this application, in which presently preferred embodiments of the invention are illustrated by way of example. It is expressly understood, however, that such figures are for the purpose of illustration and description only, and not intended as a definition of the limits of the invention. In the accompanying drawings.

DETAILED DESCRIPTION OF PREFERRED EMBODIMENTS

Figure 1:
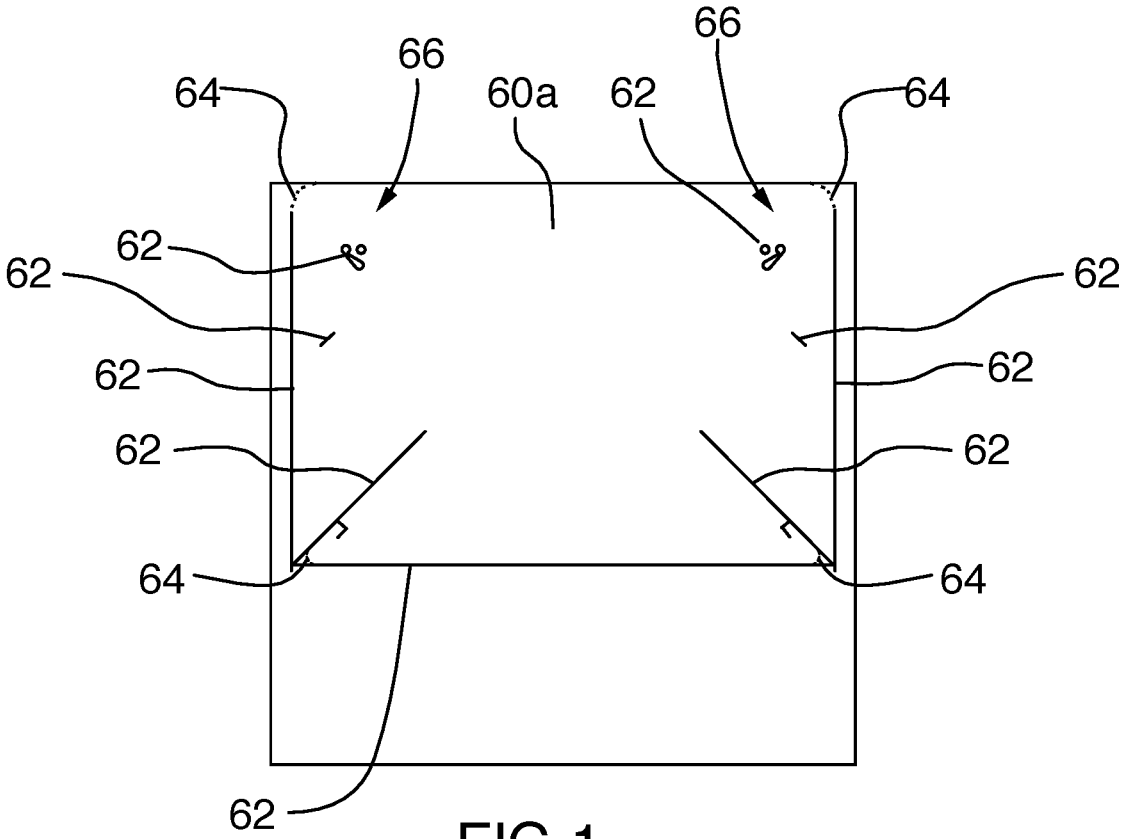
FIG. 1 is a rear elevational view of a clear sheet for a small face shield device according to a preferred embodiment of the invention.
Figure 2:
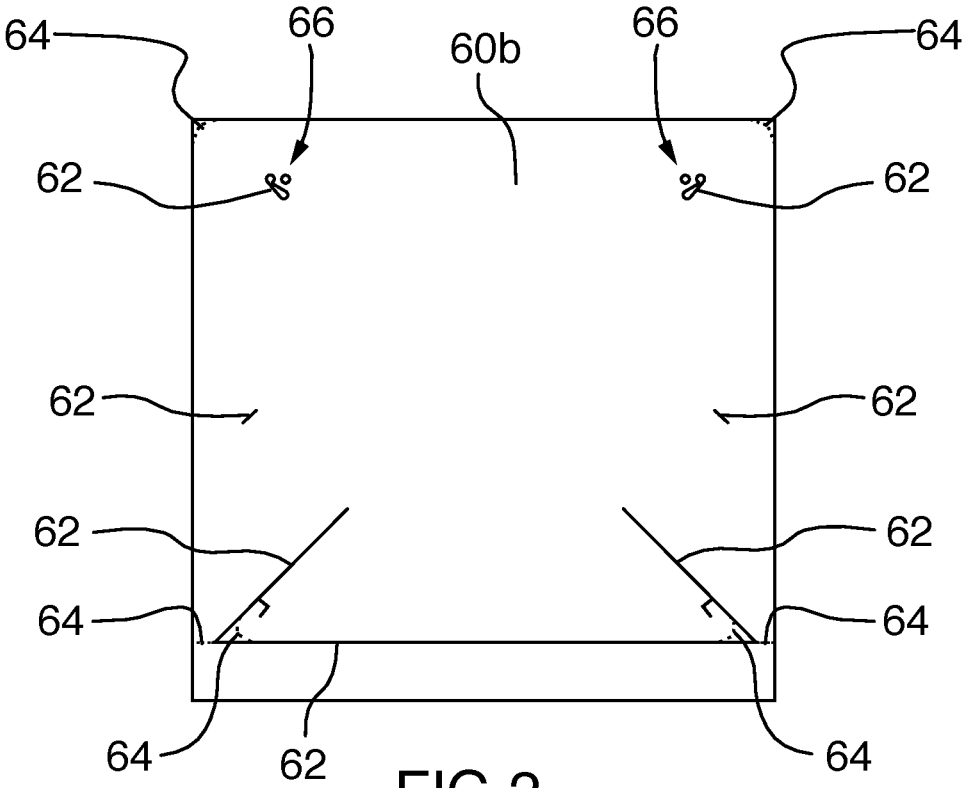
FIG. 2 is a rear elevational view of a clear sheet for a medium face shield device according to another preferred embodiment of the invention.
Figure 3:
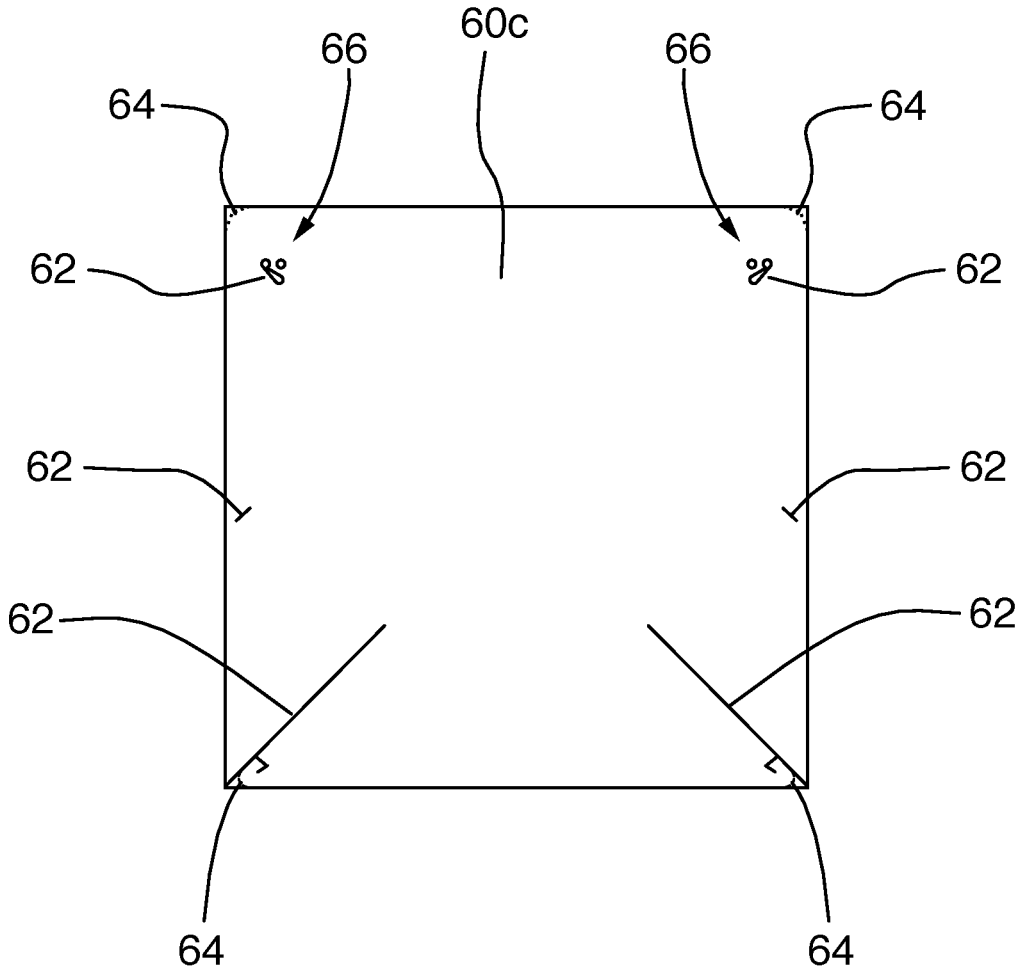
FIG. 3 is a rear elevational view of a clear sheet for a large face shield device according to yet another preferred embodiment of the invention.

This disclosure and/or the accompanying figures may include one or more dimensions and/or may or may not be shown to scale and, in any event, are shown by way of example. It may bear repeating, in this respect specifically, that such figures and/or disclosures are for the purpose of illustration and description only, and not intended as a definition of the limits of the invention.

Additionally, one or more of the directional terms (e.g., front, top, back, bottom, side) or other terms used herein, and in and/or with reference to the accompanying figures, may be otherwise regarded and/or referenced using other terms.

FIGS. 1 to 32 show selectively pivotable face shield devices, systems, and/or methods, according to preferred embodiments of the invention, for use with user headgear 44, 44, 54 (e.g., a baseball cap 44, a visor-style hat 44', and/or headworn frames, such as, for example, eyeglass frames 54) and for physically blocking noxious airborne substances. The device 70 preferably includes a face shield member 80 and clip members 130.

The face shield member 80 is preferably formed from a flat sheet 60*a* 60*b*, 60*c*, 60*a*', 60*b*', 60*c*', 60*d*' that can be resiliently deformed and is constructed from an optically clear plastic material, as best seen in FIGS. 1-9. The sheet 60*a* 60*b*, 60*c*, 60*a*', 60*b*', 60*c*', 60*d*' is preferably machine cut 62 to define one or more fold notches 102*a*, 102*b* and mating tongues 106*a*, 106*b*. A number of manual cuts 64 are also preferably cut into the sheet 60*a* 60*b*, 60*c*, 60*a*', 60*b*', 60*c*', 60*d*' to free the face shield member 80 therefrom, and the face shield member 80 is preferably shaped with two prefold lines 88, before it is folded into a folded configuration.

Figure 4:
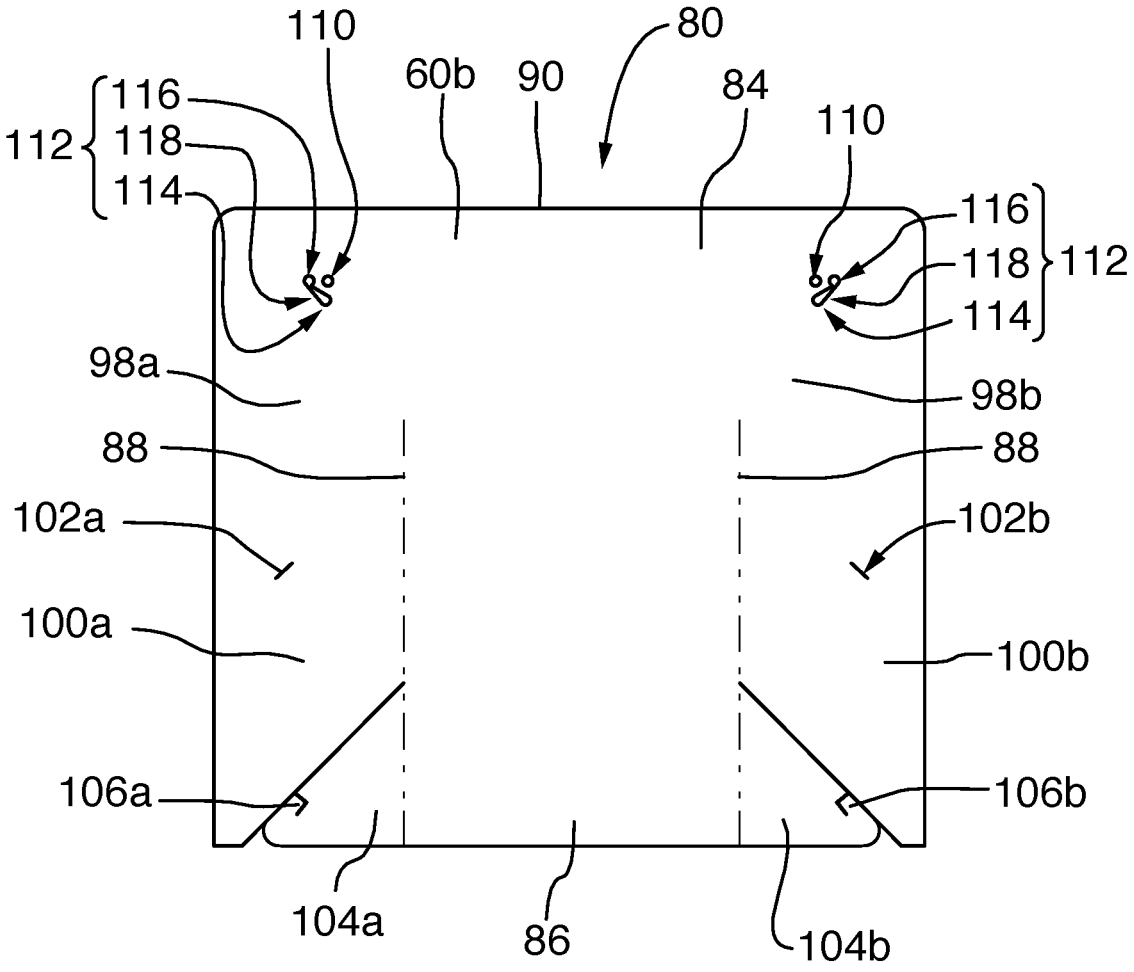
FIG. 4 is a rear elevational view of the clear sheet of FIG. 2, shown fully cut and in an unfolded flat-packable configuration according to a preferred embodiment of the invention.
Figure 5:
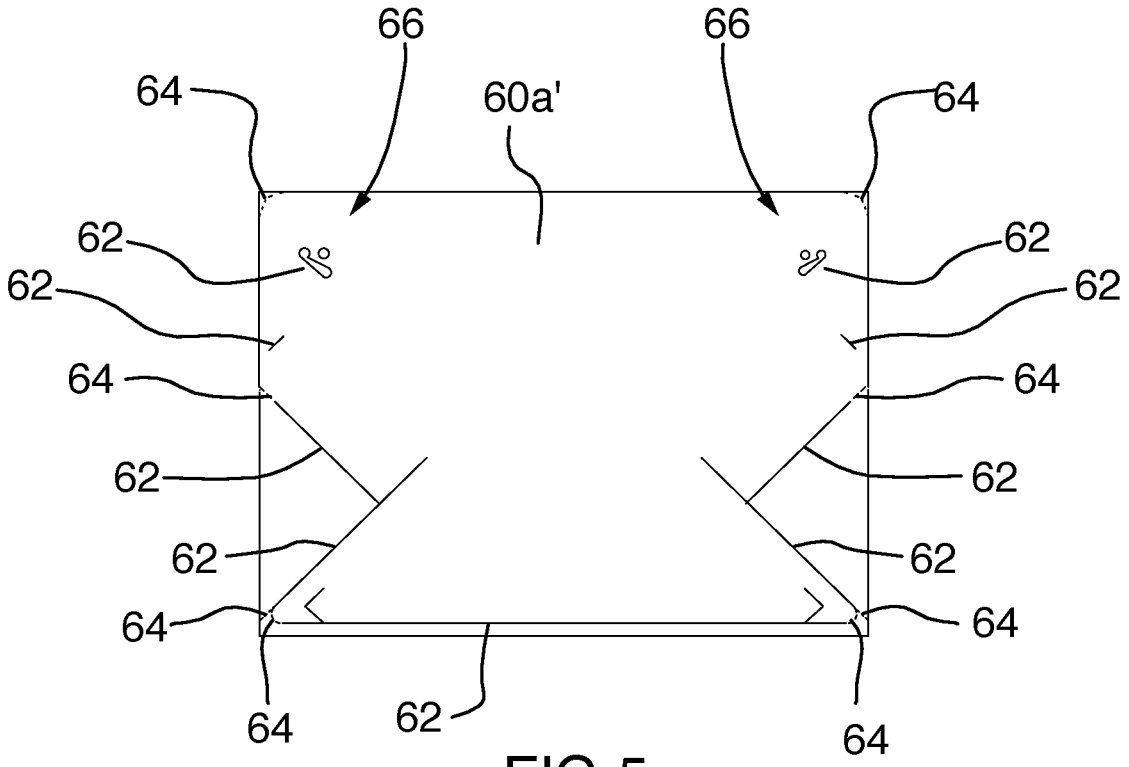
FIG. 5 is a rear elevational view of a clear sheet for an extra small face shield device according to a further preferred embodiment of the invention.
Figure 6:
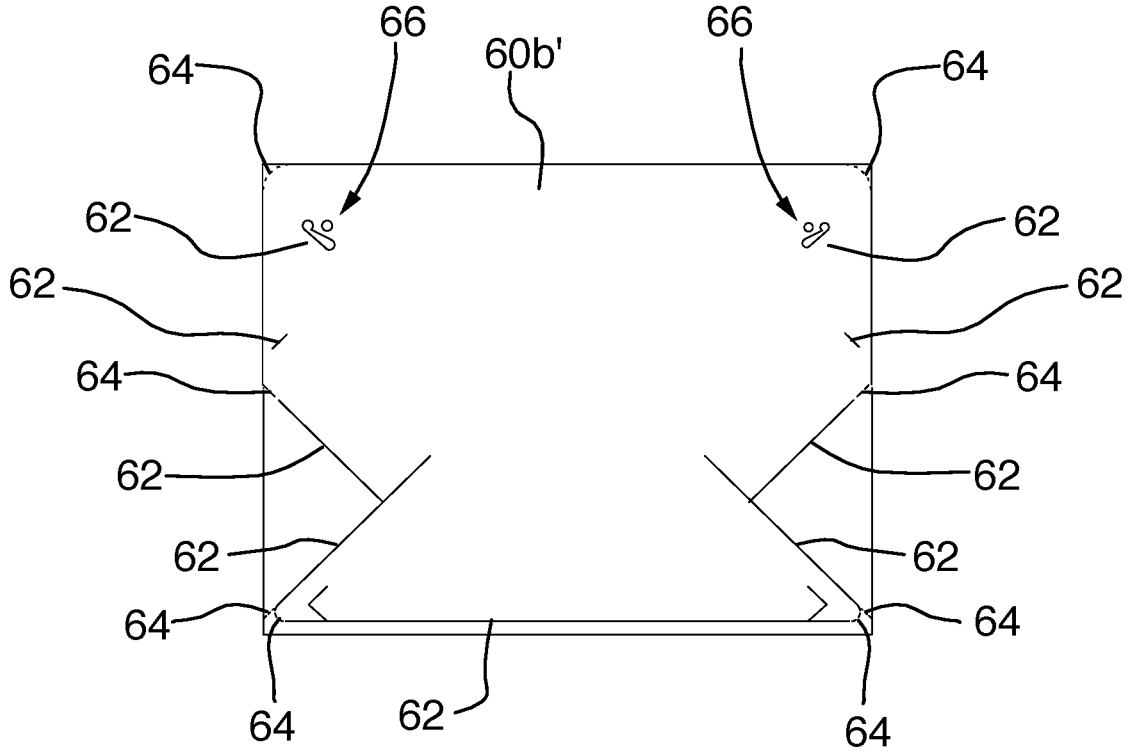
FIG. 6 is a rear elevational view of a clear sheet for a small face shield device according to another preferred embodiment of the invention.
Figure 7:
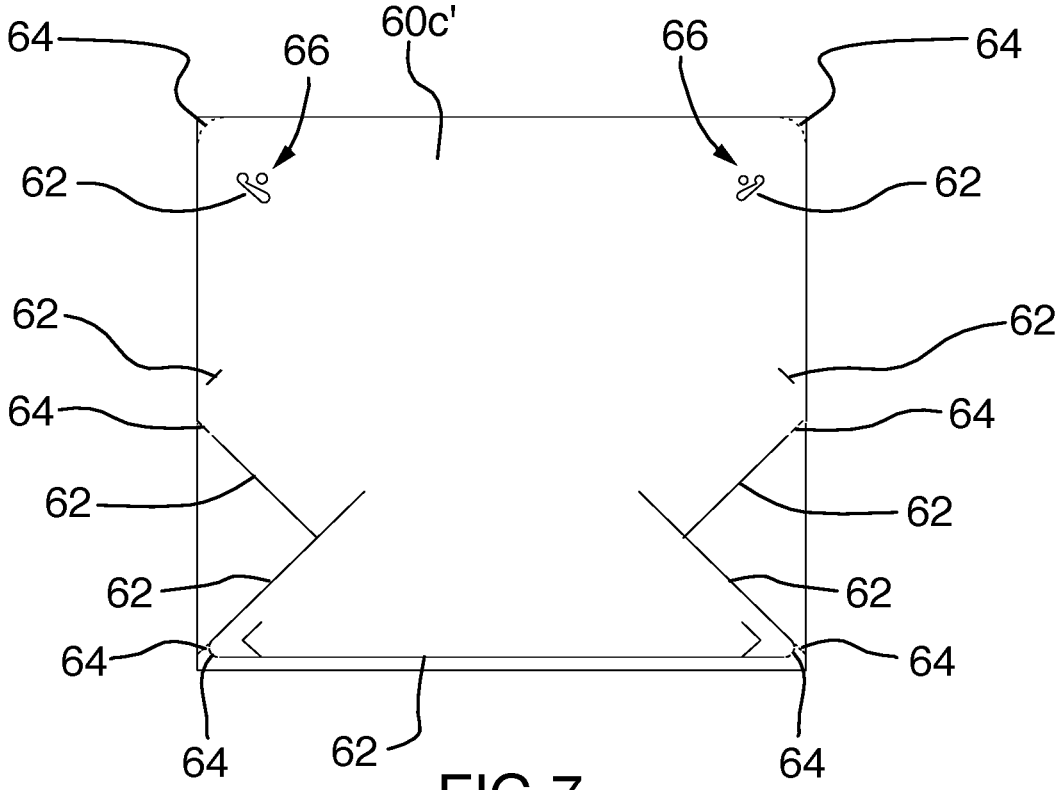
FIG. 7 is a rear elevational view of a clear sheet for a medium face shield device according to a yet further preferred embodiment of the invention.
Figure 8:
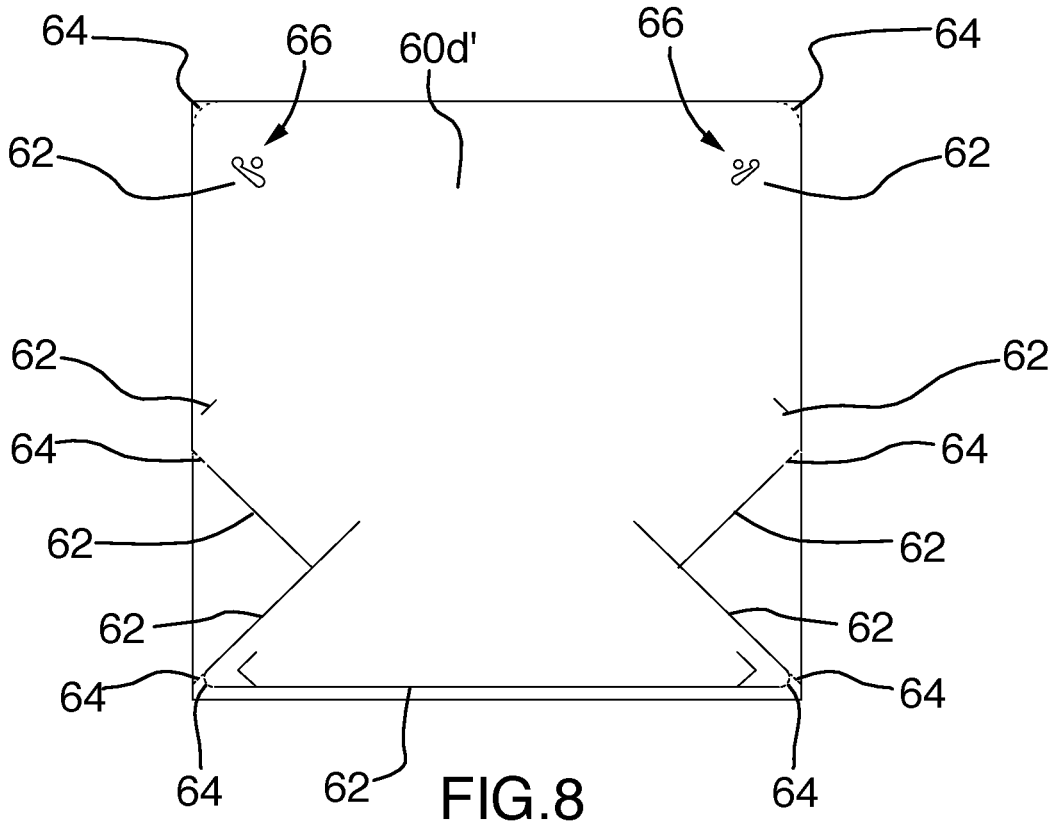
FIG. 8 is a rear elevational view of a clear sheet for a large face shield device according to yet another preferred embodiment of the invention.
Figure 9:
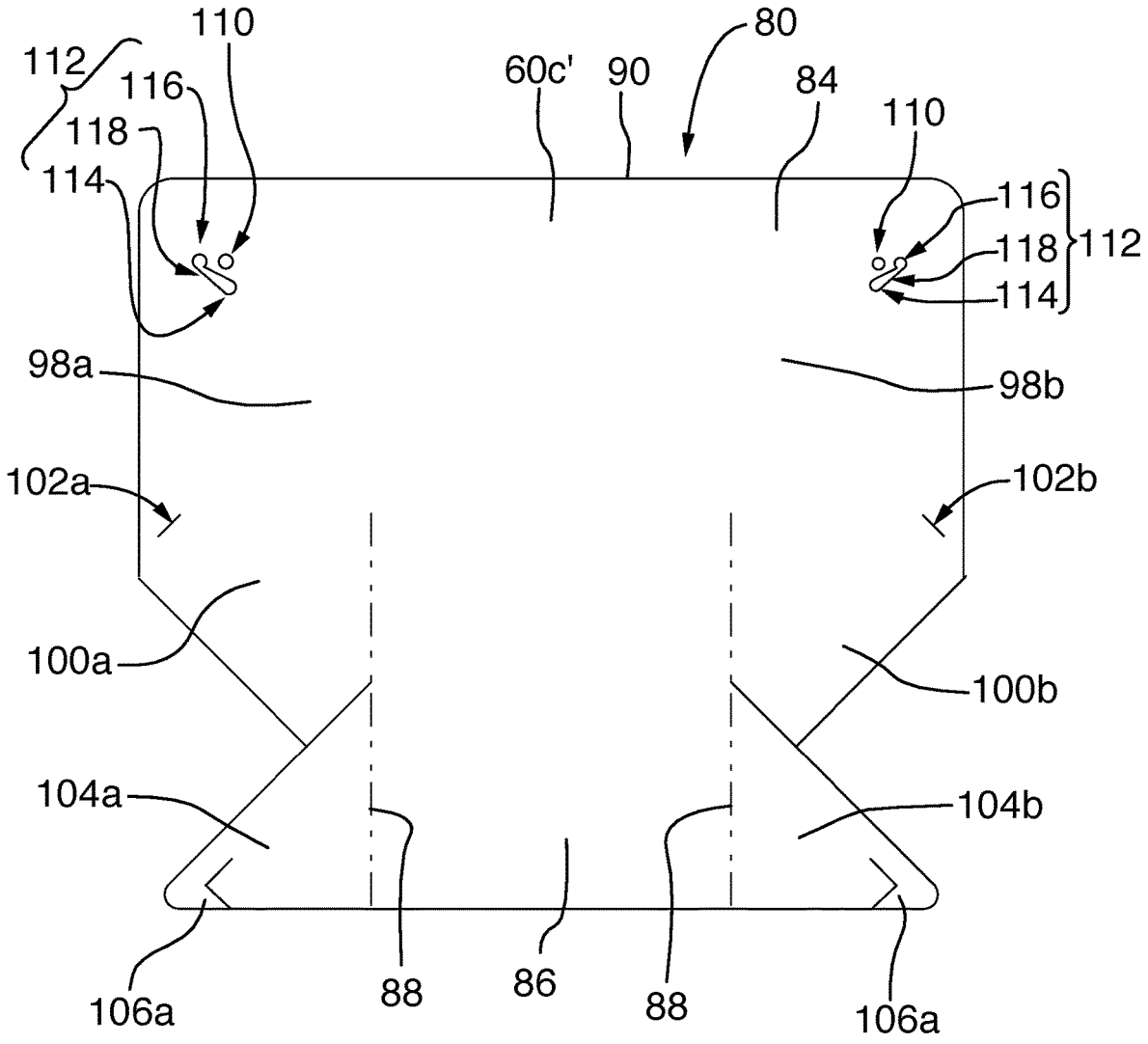
FIG. 9 is a rear elevational view of the clear sheet of FIG. 7, shown in the fully cut and unfolded flat-packable configuration.
Figure 16:
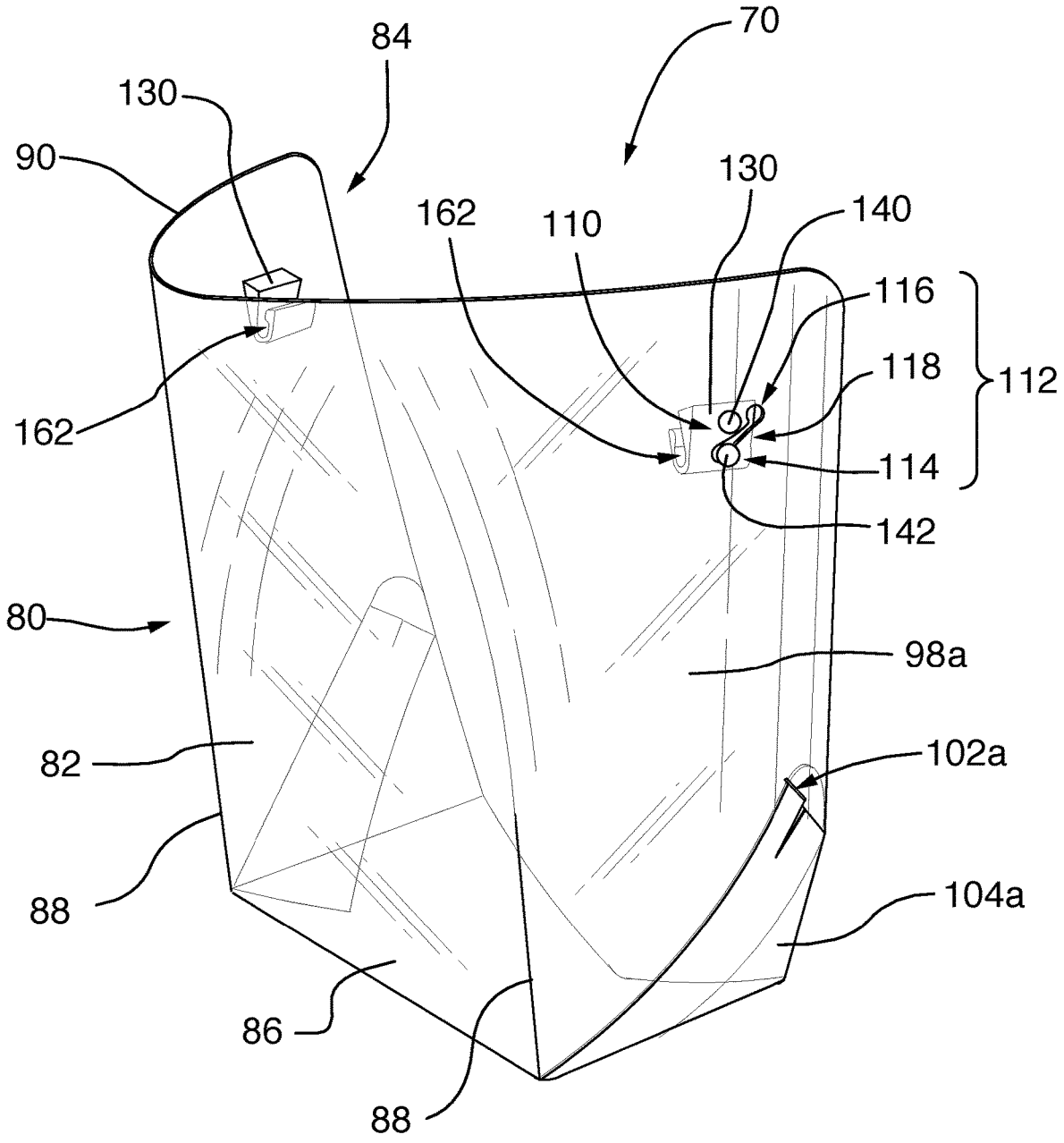
FIG. 16 is a top front left perspective view of a face shield device, showing the clip member of FIG. 10 and the clear sheet of FIG. 9 in a folded configuration, according to a preferred embodiment of the invention.
Figure 17:
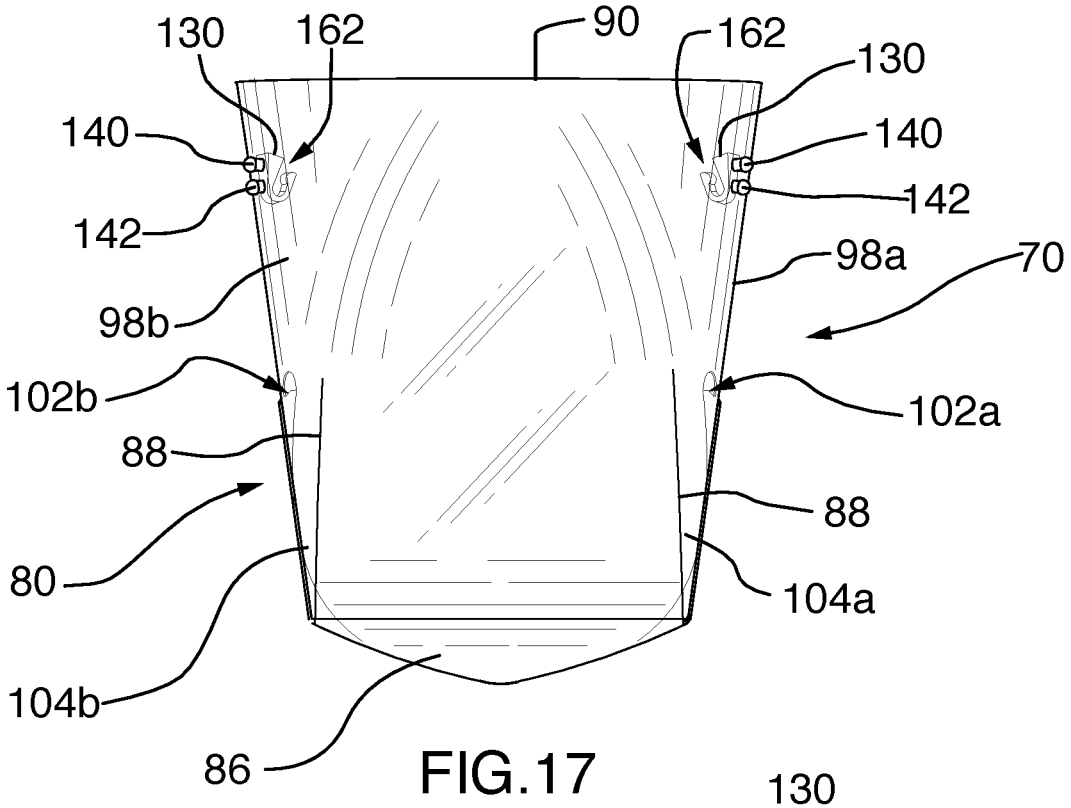
FIG. 17 is a front elevational view of the face shield device of FIG. 16.
Figure 18:
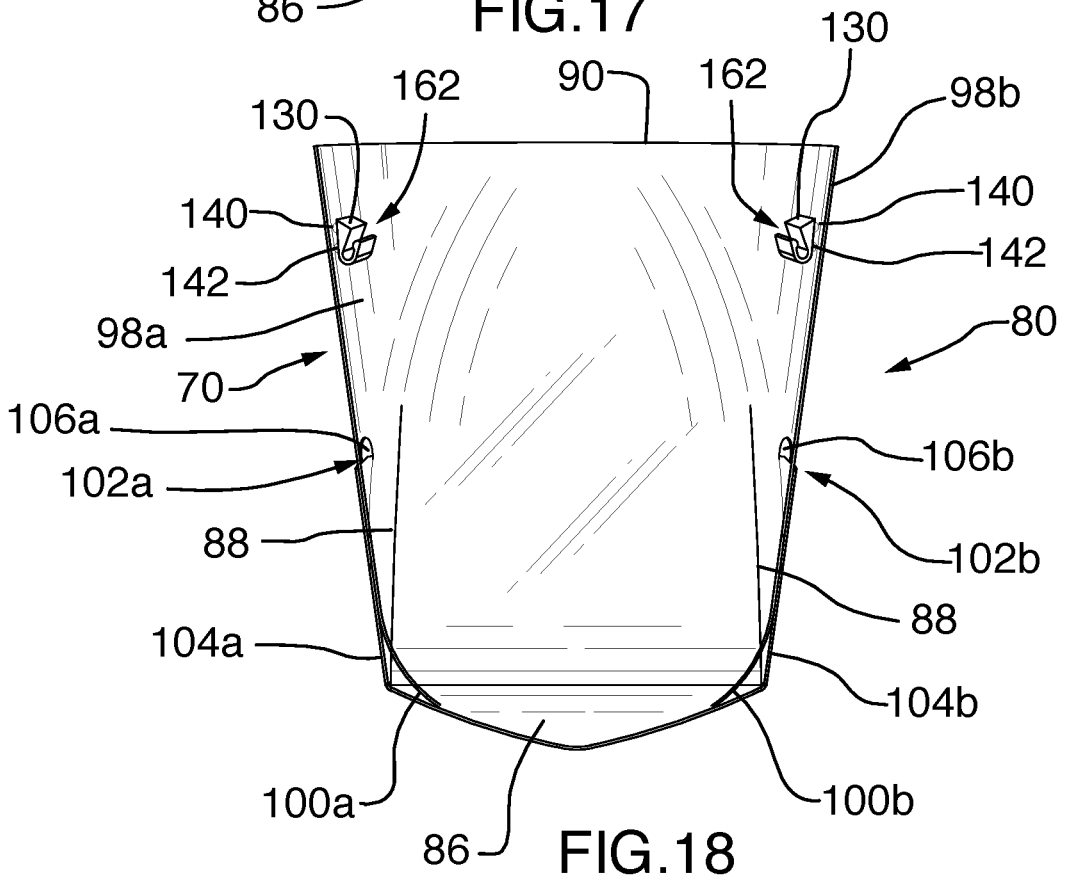
FIG. 18 is a rear elevational view of the face shield device of FIG. 16.

In folding the face shield member 80 into the folded configuration, as may be best appreciated from a consideration of FIGS. 4, 9, and 16, inner side portions 100*a*, 100*b* fold inward, a bottom shield portion 86 folds upward, and outer side portions 104*a*, 104*b* fold over the inner side portions 100*a*, 100*b*. The fold notches 102*a*, 102*b* preferably securely engage the mating tongues 106*a*, 106*b* to maintain the face shield member 80 in the folded configuration.

Figure 25:
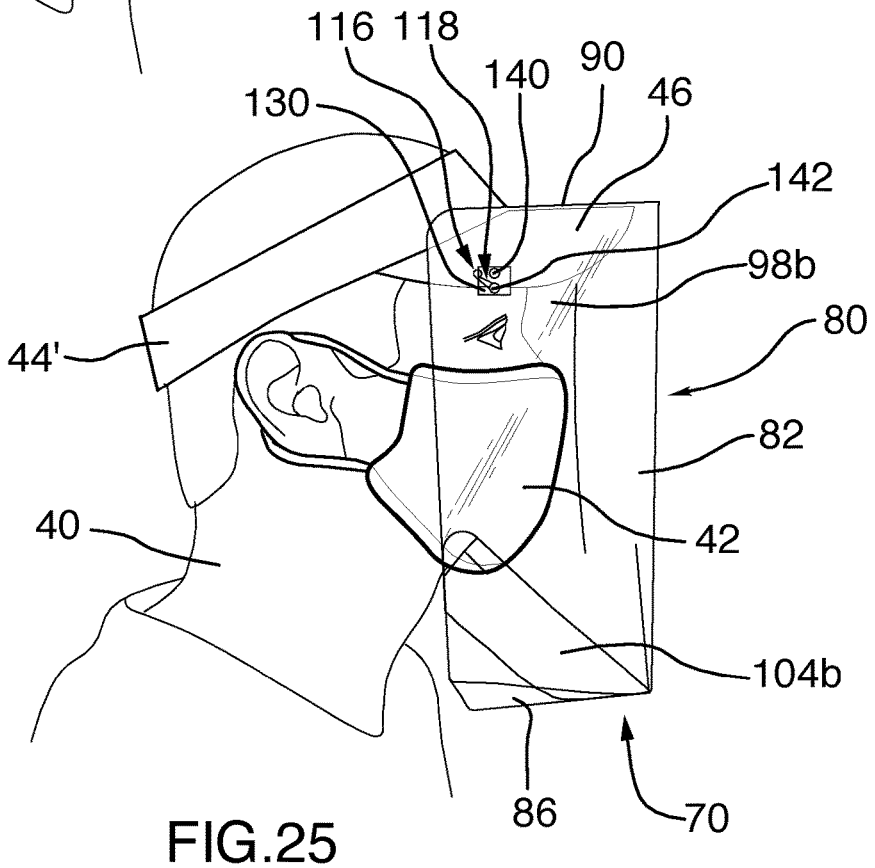
FIG. 25 is a right side elevational view of the face shield device of FIG. 20, showing a user wearing a visor-style hat and a face mask.
Figure 26:
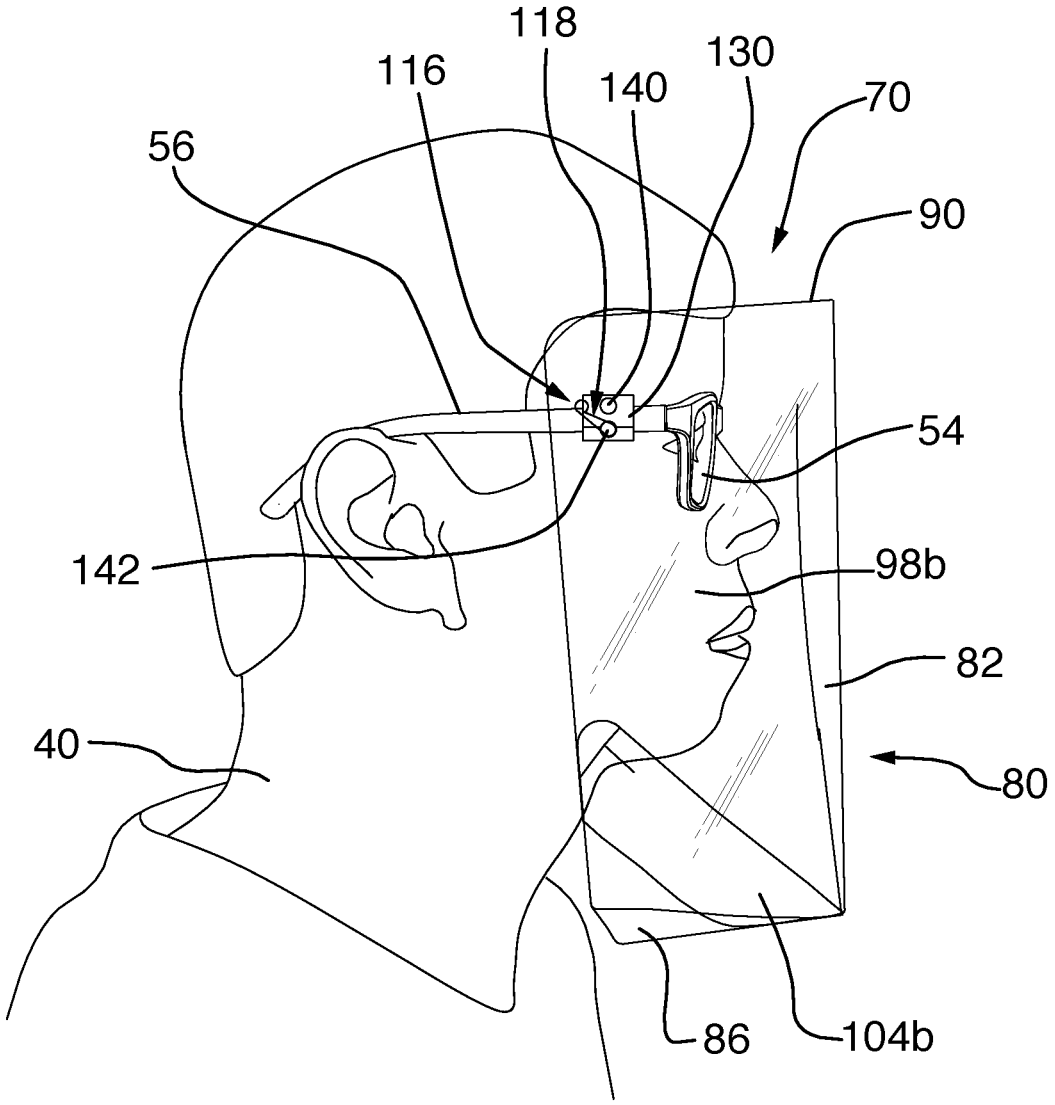
FIG. 26 is a right side elevational view of the face shield device of FIG. 20, showing a user wearing eyeglass frames.
Figure 28:
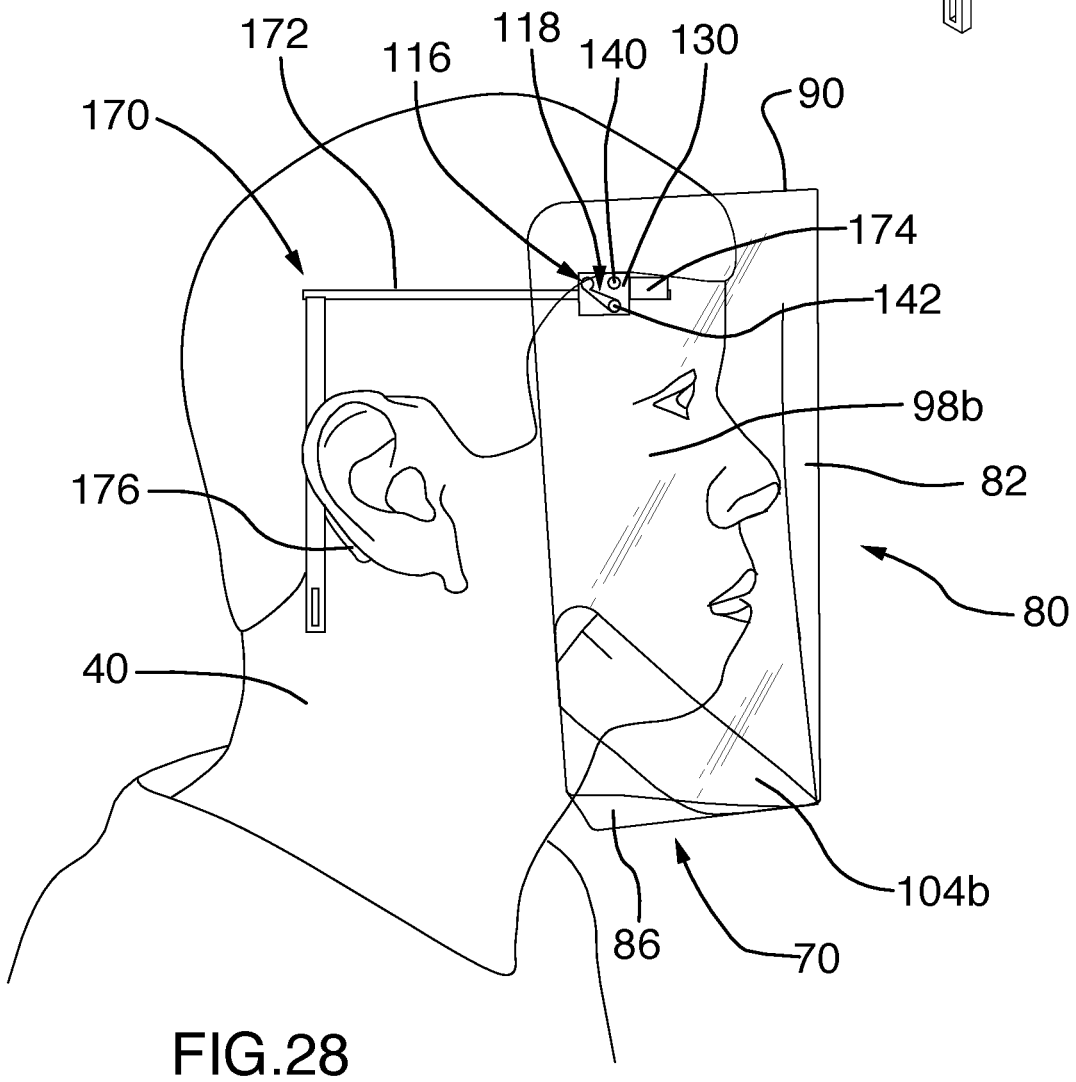
FIG. 28 is a right side elevational view of the face shield device of FIG. 20, showing a user wearing the behind-ear support member of FIG. 27.

As perhaps best seen in FIGS. 16-22, the face shield member 80 has a top edge 90, a front shield portion 82, and an enclosing bottom shield portion 86. The front shield portion 82 preferably provides a substantially unobstructed frontal view of the user 40. The enclosing bottom shield portion 86 preferably extends rearward from the front shield portion 82 under the user's chin (as shown in FIGS. 25-26, and 28).

The face shield member 80 has side shield portions 98*a*, 98*b*. Each side shield portion 98*a*, 98*b* is preferably shaped to define a forward upper pivot hole 110, a lower hole (alternately, a "wide hole") 114, and a rear upper raised hole 116 therethrough.

The face shield member 80 also has stop members. Each stop member can preferably be provided in the form of a triangular-cut stop channel 118 through the side shield portion 98*a*, 98*b*. The stop channel 118 preferably extends from the wide hole 114 to the raised hole 116, narrowing as it does so.

As shown in FIGS. 10-14, each clip member 130 preferably has a clipping portion 132, 150, 152, a top pivot knob member 140, and a bottom sliding knob member 142. Each clipping portion 132, 150, 152 preferably has an outer arm portion 132, an inner arm portion 152, and a bottom portion 150 that securely engages the outer arm portion 132 and the inner arm portion 152. The inner arm portion 152 preferably has an inner surface 154 and a bulging tip portion 156 that is raised above the inner surface 154. The outer arm portion 132 preferably has an inner surface 136 and an exterior facing portion 134. The pivot and sliding knob members 140, 142 securely engage and extend outward from the exterior facing portion 134 of the outer arm 132.

The clipping portion 132, 150, 152 of each clip member 130 preferably defines an interior recess 162. In use, the clipping portion 132, 150, 152 of each clip member 130 can preferably be selectively secured to the headgear 44, 44', 54—e.g., to the brim 46 of a baseball cap 44 or visor-style hat 44', or to the arms 56 of headworn frames, such as, for example, eyeglass frames 54. It preferably can also be selectively removed therefrom. The headgear 44, 44', 54 (e.g., hat brim 46 or eyeglass frame arm 56) is preferably secured within the interior recess 162 between the bulging tip portion 156 of the inner arm 152 and the inner surface 136 of the outer arm 132. (Herein, references to eyeglass frames should be understood to encompass headworn frames generally.)

Figure 15:
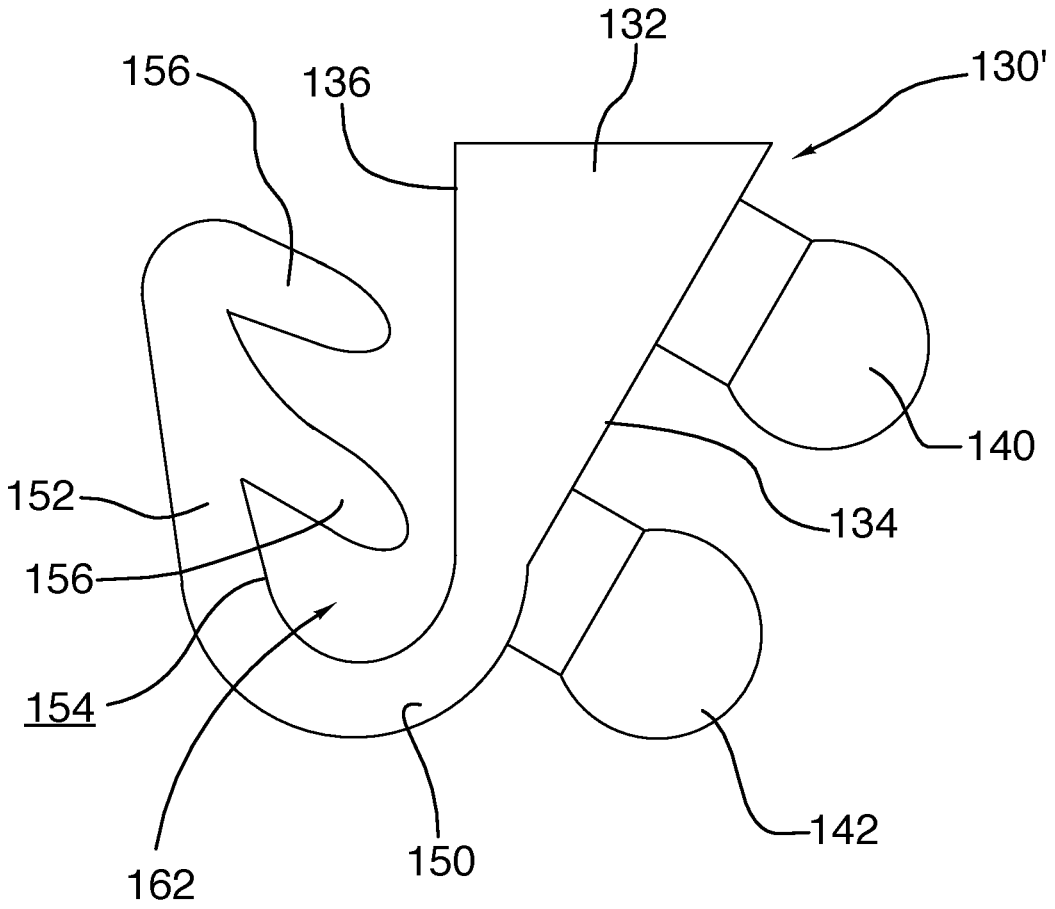
FIG. 15 is a front elevational view of a clip member for a face shield device according to another preferred embodiment of the invention.

In some preferred embodiments, the device 70 may include an alternate clip member 130' (as shown in FIG. 15). Alternate clip members 130' may have two or more bulging tip portions 156 that extend downwardly into the interior recess 162. In this way, to perhaps better engage the user headgear 44, 44', 54.

The pivot knob member 140 of each clip member 130 preferably extends, in selectively pivotable engagement, through the pivot hole 110 in an adjacent side shield portion 98*a*, 98*b*. In this way, the face shield member 80 pivotably engages the clip members 130. The sliding knob member 142 preferably extends, in sliding engagement, through a stop slot 112 that is formed, collectively, by the wide hole 114, the stop channel 118, and the raised hole 116.

Figure 10:
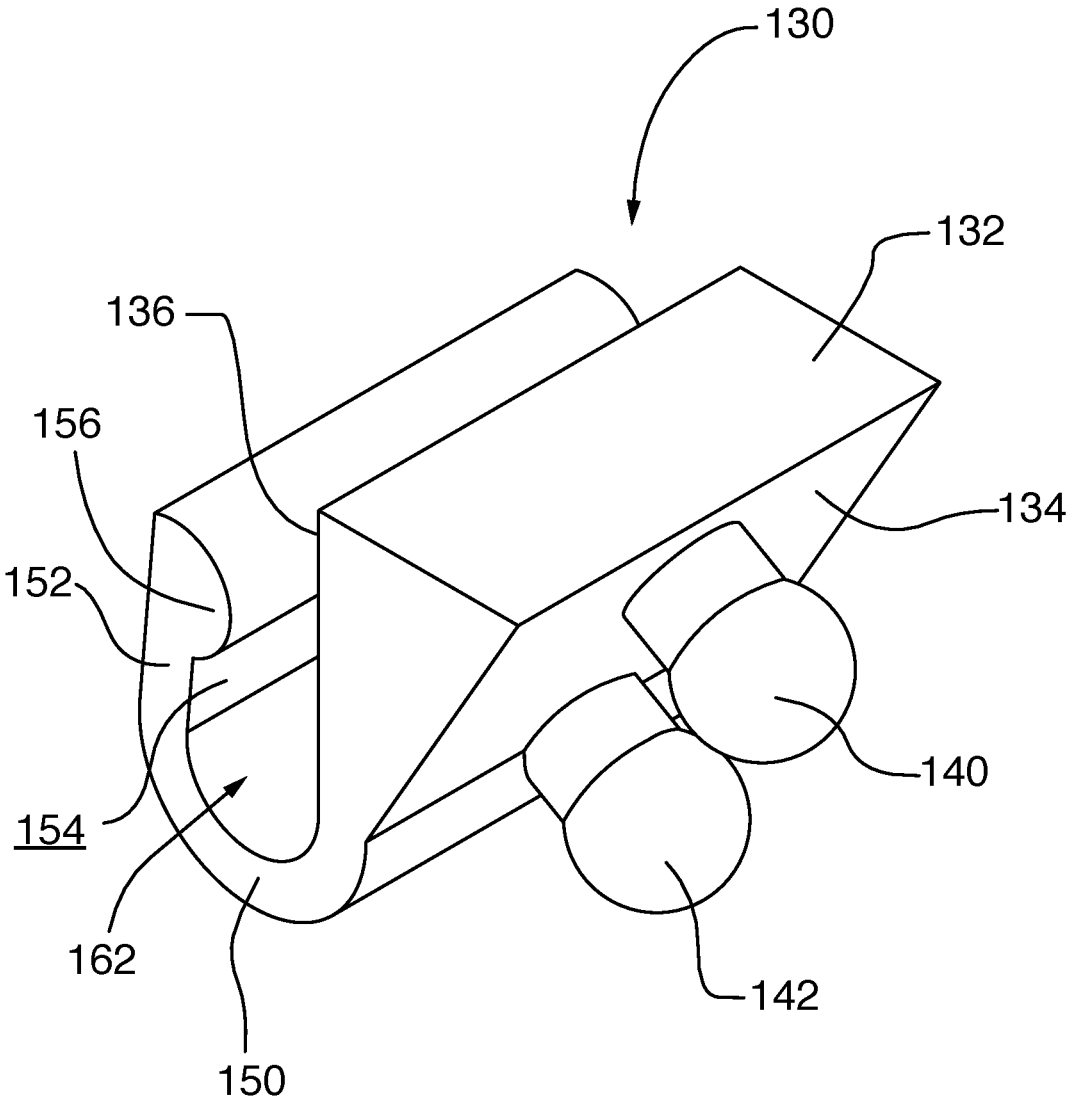
FIG. 10 is a top front left perspective view of a clip member for a face shield device according to a preferred embodiment of the invention.
Figure 11:
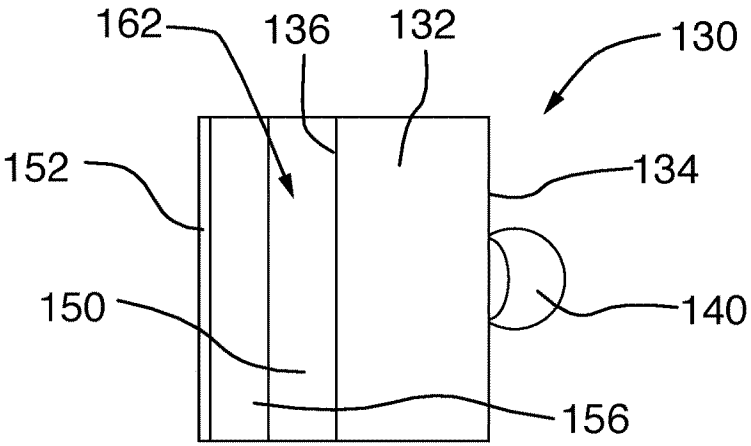
FIG. 11 is a top plan view of the clip member of FIG. 10.
Figure 12:
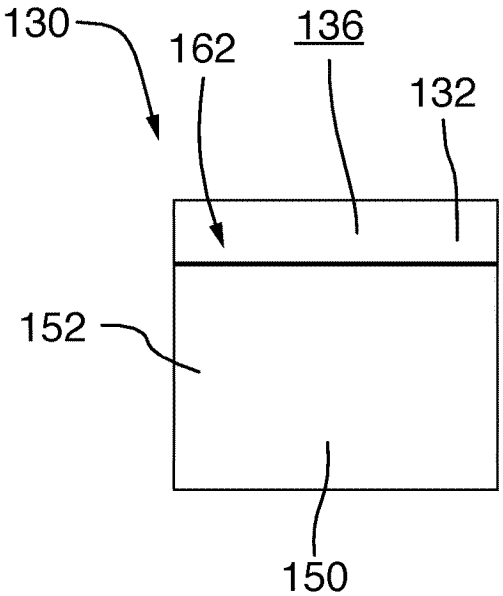
FIG. 12 is a right side elevational view of the clip member of FIG. 10.
Figure 13:
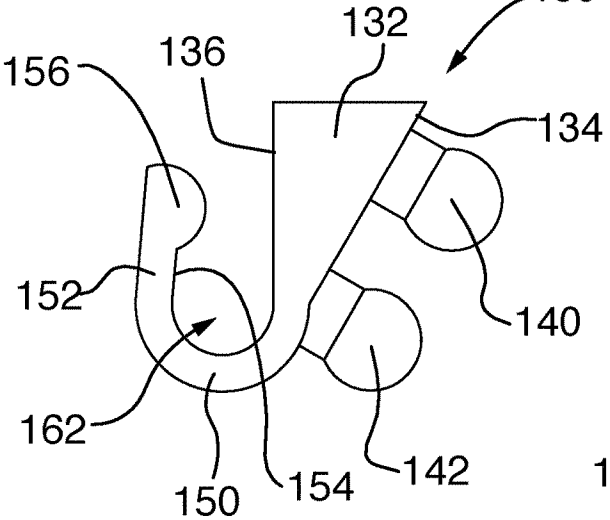
FIG. 13 is a front elevational view of the clip member of FIG. 10.
Figure 14:
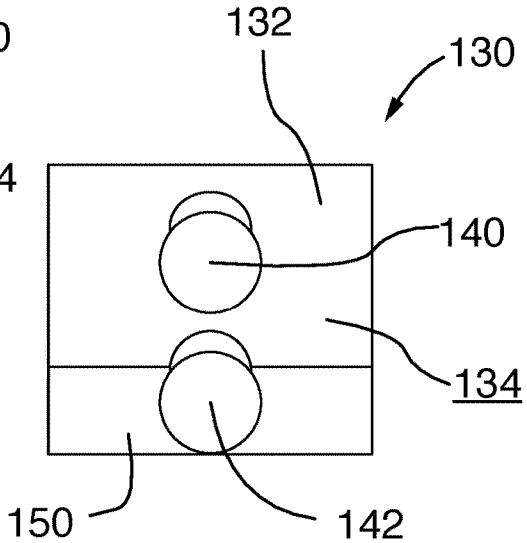
FIG. 14 is a left side elevational view of the clip member of FIG. 10.

The knobs 140, 142 of the clip members 130 securely engage the face shield member 80. As best seen in FIGS. 10 and 13, the exterior facing portion 134 on the outer arm 132 of the clip member 130 is preferably angled relative to the inner surface 136 on the outer arm 132 such that, in use, the face shield member 80 preferably hangs substantially parallel to the user's face.

Figure 19:
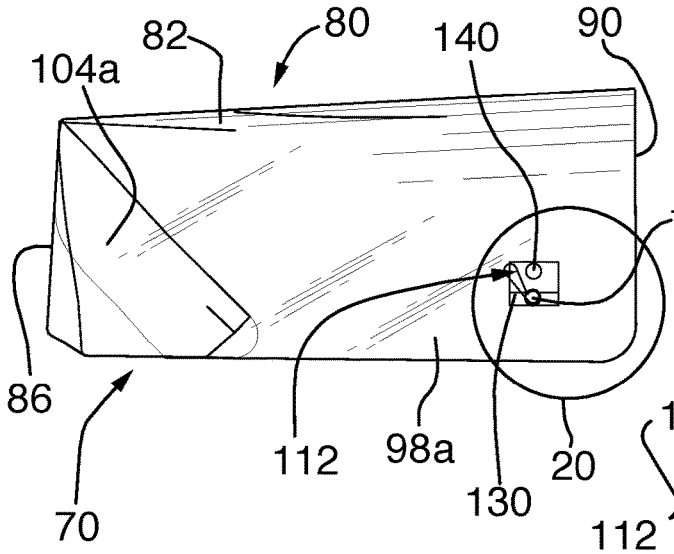
FIG. 19 is a left side elevational view of the face shield device of FIG. 16, shown in a flipped-up open configuration.
Figure 21:
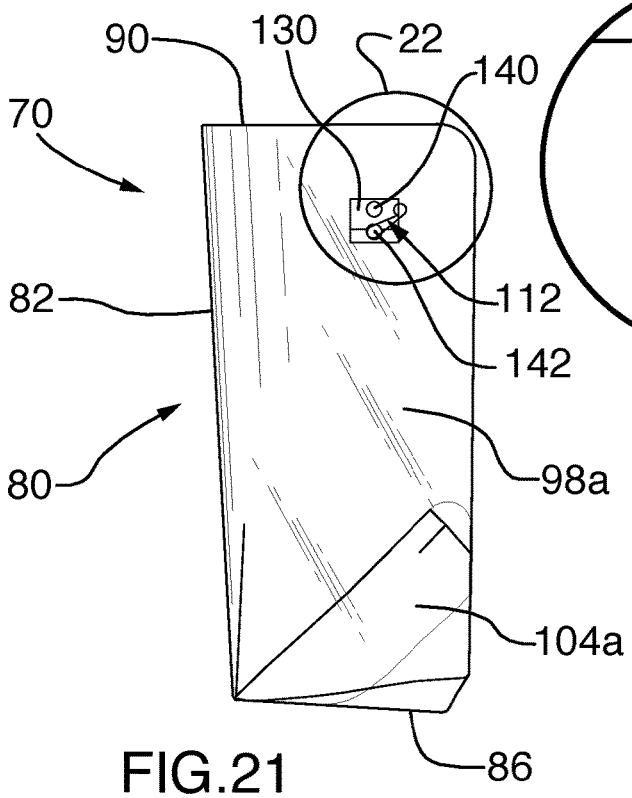
FIG. 21 is a left side elevational view of the face shield device of FIG. 16, shown in a flipped-down closed configuration.

Preferably, as aforesaid, the face shield member 80 is pivotably secured to the headgear 44, 44' 54 for selective pivoting between an open configuration and a closed configuration, as shown in FIGS. 19 and 21.

Figure 22:
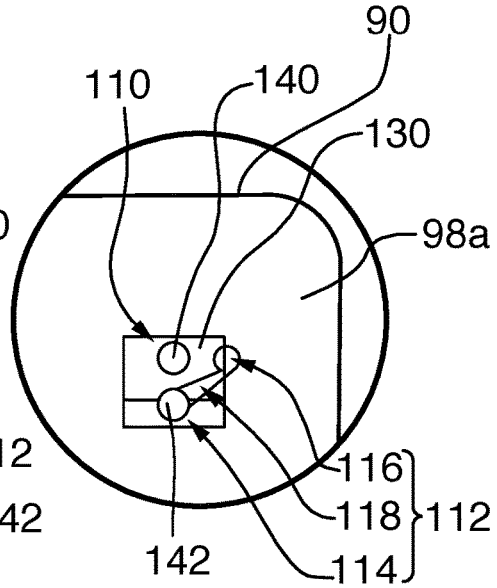
FIG. 22 is a close-up detailed view on encircled portion 22 of FIG. 21.

The face shield member 80 is gravity-biased towards the closed configuration, as shown in FIGS. 21 and 22. In the closed configuration, the sliding knob member 142 preferably rests in the wide hole 114. The closed configuration physically blocks noxious airborne substances.

The face shield member 80 is selectively pivotable against the aforesaid gravity-biasing away from the closed configuration, past the stop members and/or stop channel 118, into the open configuration. When the face shield member 80 is pivoted away from the closed configuration, the sliding knob member 142 preferably slides through the stop channel 118 and into the raised hole 116 in the open configuration.

Figure 20:
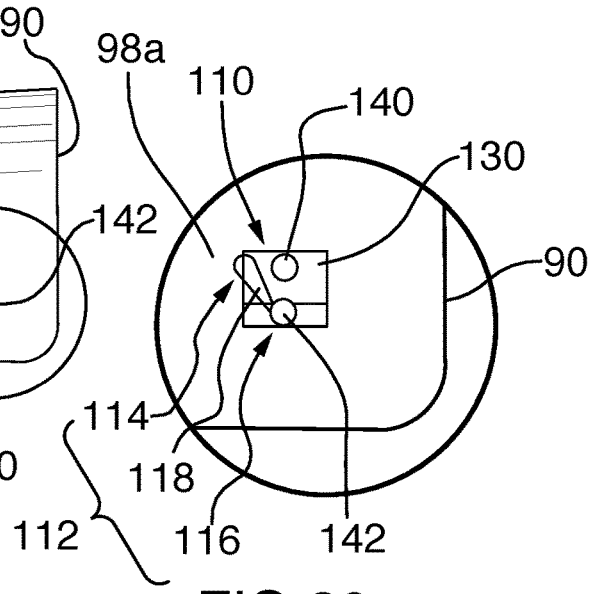
FIG. 20 is a close-up detailed view on encircled portion 20 of FIG. 19.

In the open configuration, as shown in FIGS. 19 and 20, the stop members and/or stop channel 118 withstand the aforesaid gravity-biasing and keep the face shield member 80 in the open configuration. In the open configuration, the narrowing of the stop channel 118 preferably obstructs the sliding knob member 142 and keeps it in the raised hole 116.

Each stop member and/or stop channel 118 can be resiliently deformed to permit sliding of the sliding knob member 142 away from the raised hole 116, through the stop channel 118, towards the wide hole 114, and to permit pivoting of the face shield member 80 away from the open configuration towards the closed configuration.

Figure 23:
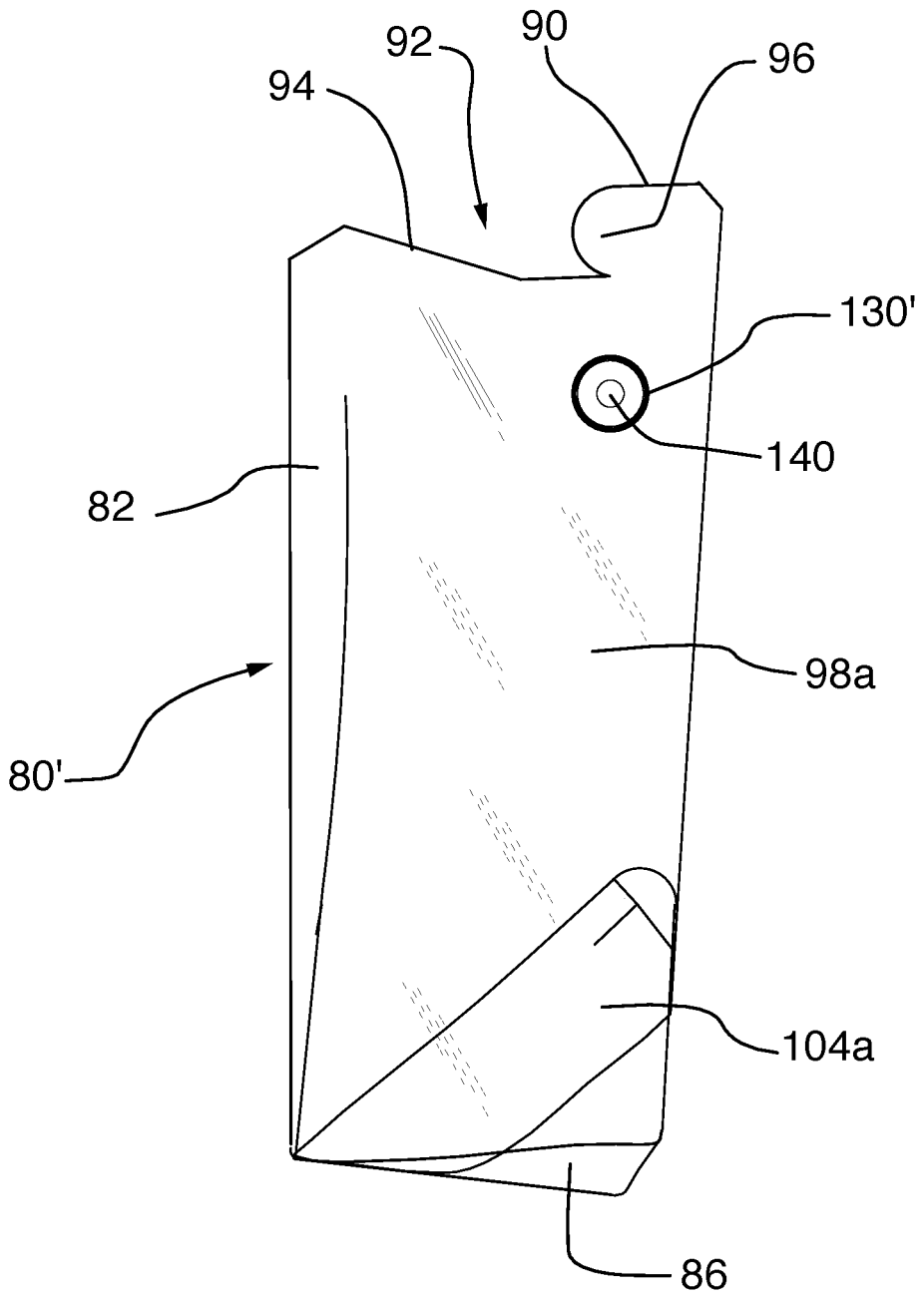
FIG. 23 is a left side elevational view of a face shield device according to another preferred embodiment of the invention.

In some preferred embodiments, as best seen in FIG. 23, the stop members take the form of a top stop portion 96 in a top notch 92 along the top edge 90 of an alternate face shield member 80' adjacent to its side shield portion 98*a*, 98*b*. The top notch 92 also has a slide portion 94 adjacent to the top stop portion 96. In the open configuration, the top stop portion 96 preferably engages an underside of the headgear 44, 44', 54 and keeps the face shield member 80' in the open configuration. The top stop portion 96 can be resiliently deformed to permit removal from the headgear 44, 44', 54 and pivoting of the face shield member 80' away from the open configuration towards the closed configuration. As the face shield member 80' pivots away from the open configuration, the headgear 44, 44', 54 can preferably slide along the slide portion 94 away from the top stop portion 96. In such embodiments, the alternate face shield member 80' may be provided with alternate clip members 130'. As shown in FIG. 23, each alternate clip member 130' may have a pivot knob member 140 (without any sliding knob member). This pivot knob member 140 may extend, in secure and selectively pivotable engagement, through an adjacent side shield portion 98*a* on the face shield member 80'.

Figure 29:
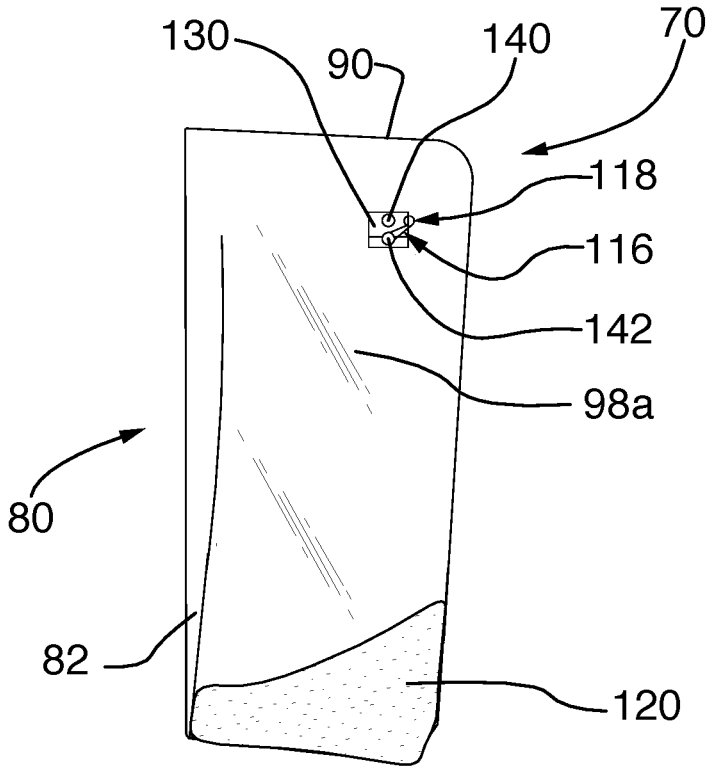
FIG. 29 is a left side elevational view a face shield device that has a filter member according to another preferred embodiment of the invention.
Figure 30:
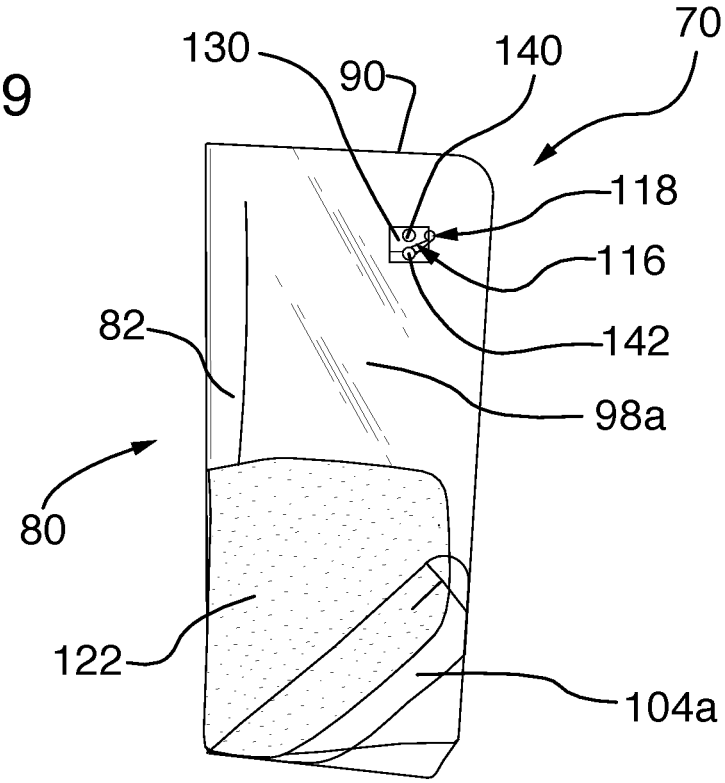
FIG. 30 is a left side elevational view of the face shield device of FIG. 20, shown with an absorbent bottom insert according to another preferred embodiment of the invention.

In some preferred embodiments, as shown in FIG. 29, the bottom shield portion 86 includes a bottom filter member 120 (attached to a rear portion 84 of the face shield member 80) that permits passage of air therethrough and physically blocks noxious airborne substances. Alternately, as shown in FIG. 30, an absorbent bottom insert 122 may be provided adjacent to the bottom shield portion 86 to absorb excess moisture that otherwise may accumulate inside the face shield member 80.

Figure 31:
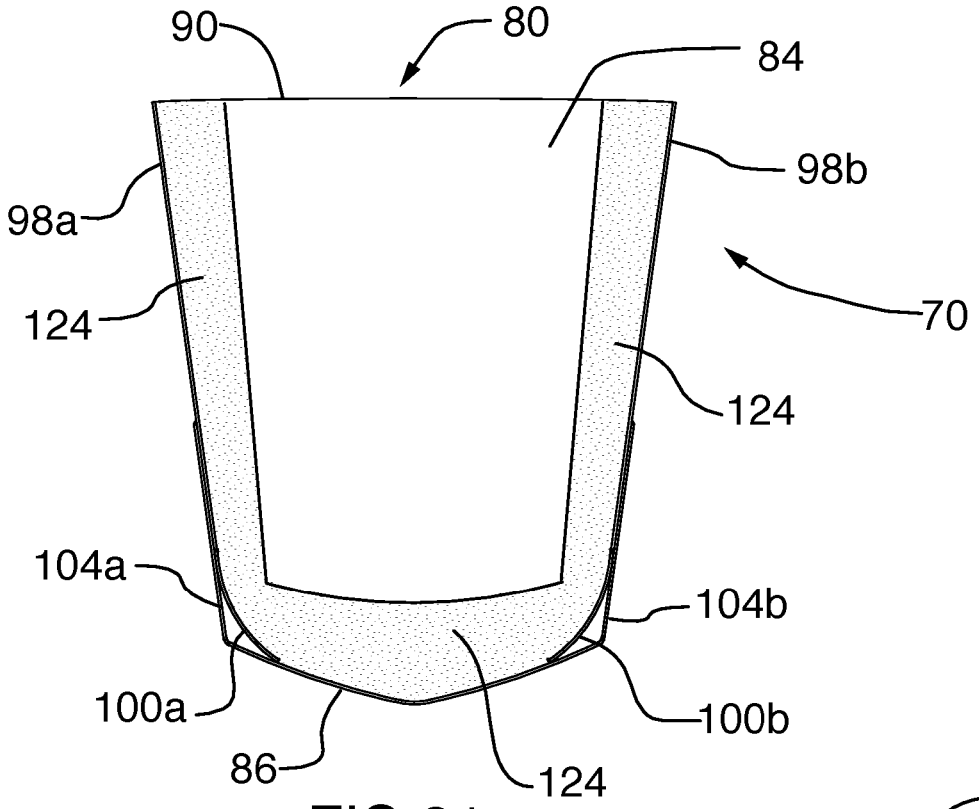
FIG. 31 is a rear elevational view of the face shield device of FIG. 20, shown with an side and bottom skirt inserts according to another preferred embodiment of the invention.
Figure 32:
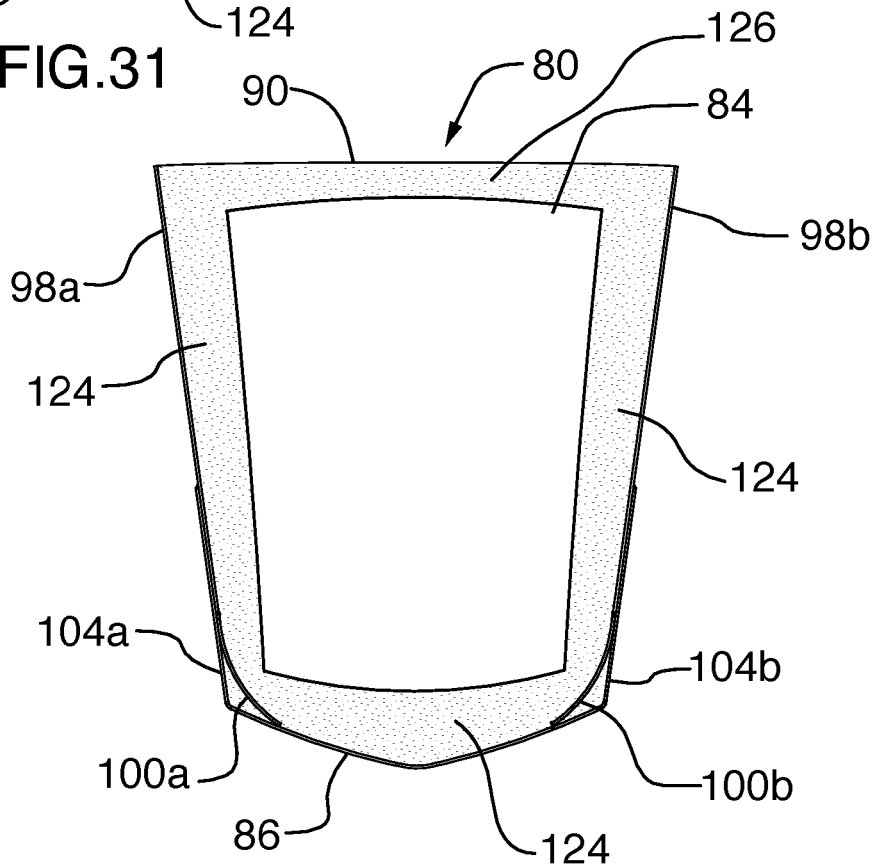
FIG. 32 is a rear elevational view of the face shield device of FIG. 31, shown with a top skirt insert according to another preferred embodiment of the invention.

In some preferred embodiments, as shown in FIGS. 31-32, the device 70 may include filter skirt inserts 124, 126 that securely engage (the rear portion 84 of) the face shield member 80. For example, side and bottom filter skirt inserts 124 may be provided, with a top filter skirt insert 126 (as shown in FIG. 32) or without one (as shown in FIG. 31). The filter skirt inserts 124, 126 extend between the face shield member 80 and the user 40, while permitting passage of air therethrough and physically blocking noxious airborne substances.

Figure 27:
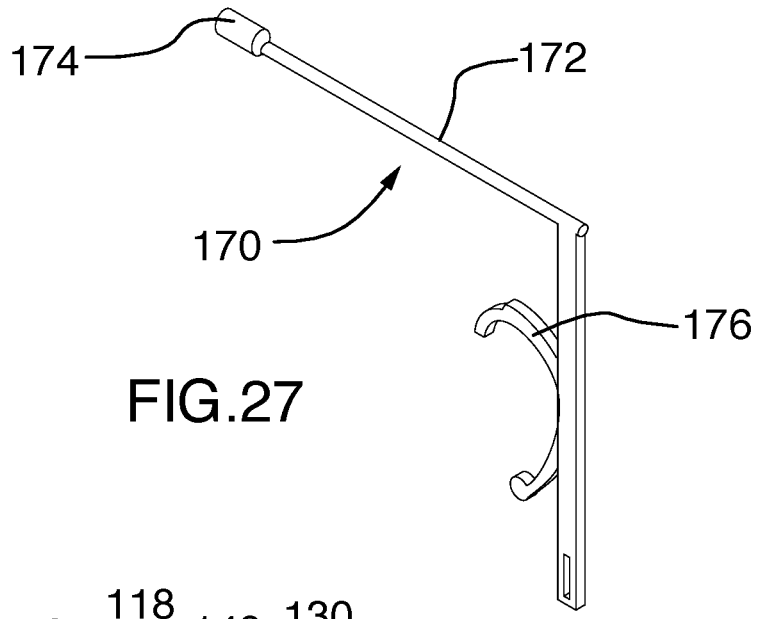
FIG. 27 is a top rear right perspective view of a behind-ear support member for a face shield device according to another preferred embodiment of the invention.

As shown in FIGS. 27-28, some preferred embodiments of the invention are provided with two behind-ear support members 170 so that no other user headgear need be worn. Each behind-ear support member 170 preferably includes an arm portion 172 and an earpiece portion 176 adapted to be worn on the user's ear. The arm portion 172 securely engages and extends forward from the earpiece portion 176. The arm portion 172 has a front end portion 174 and the clipping portion 132, 150, 152 can be secured to the arm portion 172.

In a method of forming the face shield member 80, (a) the plastic sheet 60*a*, 60*b*, 60*c*, 60*a*', 60*b*', 60*c*', 60*d*' is cut to define the fold notches 102*a*, 102*b* and mating tongues 106*a*, 106*b*. (b) The plastic sheet 60*a*, 60*b*, 60*c*, 60*a*', 60*b*', 60*c*', 60*d*' is folded into the folded configuration to form the face shield member 80 with the front shield portion 82, the side shield portions 98*a*, 98*b*, and the enclosing bottom shield portion 86 that extends rearward from the front shield portion 82. The fold notches 102*a*, 102*b* securely engage the mating tongues 106*a*, 106*b* to maintain the face shield member 80 in the folded configuration. (c) The face shield member 80 is securely attached, by the clip members 130, to the headgear 44, 44', 54 that is adapted to be worn by the user 40, with the enclosing bottom shield portion 86 extending under the user's chin, and with the face shield member 80 physically blocking noxious airborne substances.

Figure 24:
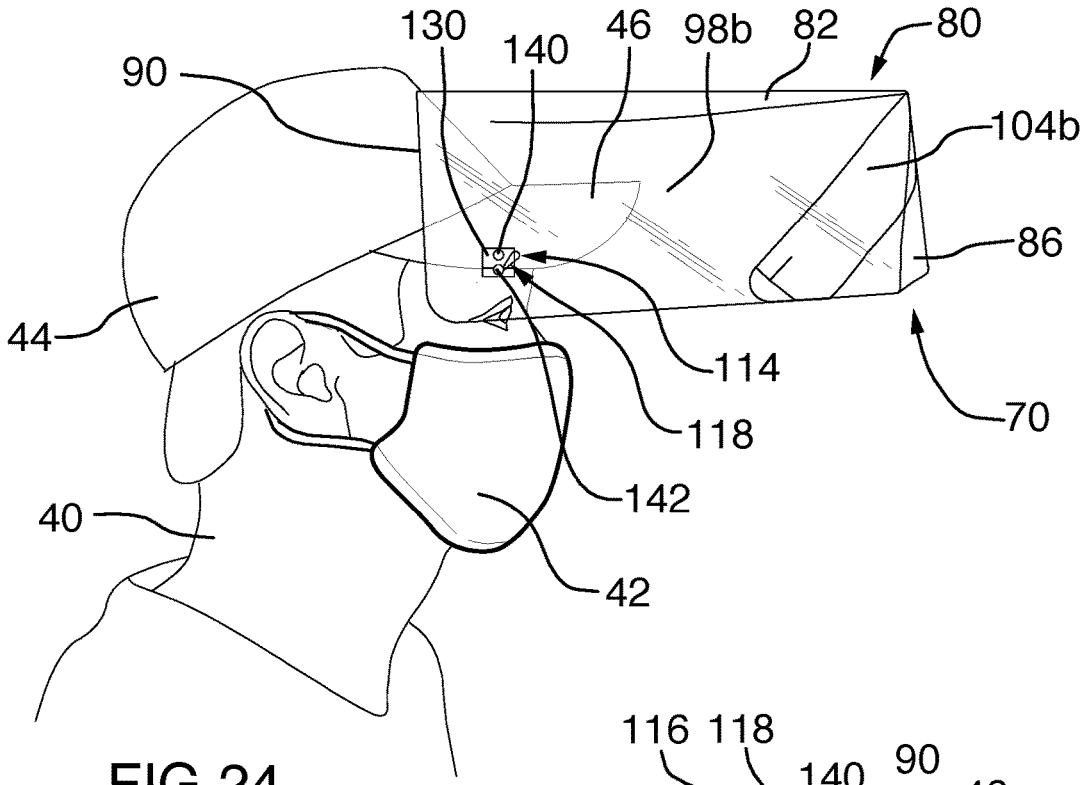
FIG. 24 is a right side elevational view of the face shield device of FIG. 19, showing a user wearing a baseball cap and a face mask.

To describe preferred embodiments of the invention in another way, the device 70 and system preferably have an optically clear face shield member 80, and two clip members 130. The device 70 is preferably adapted to be worn by the user 40. The user 40 can wear the face shield device 70 with a face mask 42 (as shown in FIGS. 24 and 25) or without one (as shown in FIGS. 26 and 28). Preferably, the face shield member 80 physically shields and helps avoid, reduce, or minimize transmission of infectious biological substances.

The clear face shield member 80 preferably has one or more elements and/or features. For example, a bottom portion 86 of the face shield member 80 is preferably enclosed, as shown in FIGS. 16, 21, 23, 25-26, and 28-30 (among others). The enclosed bottom portion 86 preferably helps to limit any escape or expulsion of droplets from the bottom of the face shield device 70.

Preferably, the face shield member 80 is constructed from a single piece of a single material. The enclosed bottom portion 86 of the face shield member 80 is preferably shaped by a series of cuts 62, 64 made into a clear plastic material. The cuts 62, 64 include machine cuts 62 and manual cuts 64. The clear plastic material is then preferably folded, adjacent to the bottom portion 86 of the face shield member 80, to create a curved and/or enclosed bottom portion 86 which can catch additional expelled droplets.

Prior to folding, the face shield member 80 preferably has a minimal profile, as may be best appreciated in view of FIGS. 4 and 9, preferably affording for smaller storage requirements and/or lower shipping costs.

The face shield member 80 is preferably adapted for potential use with one or more optional attachments. Such attachments may optionally include, but are not limited to, one or more filters 120, 122, 124, 126. The face shield member 80 has several positions where a filter 120, 122 or "skirt" 124, 126 can be attached, as shown (for example) in FIGS. 29-32. The filter 120, 122 and/or skirt 124, 126 can help to further prevent, reduce, and/or minimize any potential contaminants from escaping or being expelled to any significant distance away from the user 40, and/or any potential contaminants from entering the face shield 80 towards the user 40.

The face shield member 80 is preferably shaped to define openings 110, 112, adjacent to a top portion 90 thereof, which are adapted for attachment and secure engagement with the clip members 130. These openings 110, 112 are preferably shaped by cuts 62 in the plastic sheet 60*a*, 60*b*, 60*c*, 60*a*', 60*b*', 60*c*', 60*d*' of the face shield member 80. The openings 110, 112 are preferably shaped to enable the face shield member 80 to flip up and down. At least in part, this feature of the invention preferably affords greater airflow to the user 40.

As perhaps best seen in FIGS. 4, 9, 16, 20, and 22 the cuts 62 are preferably shaped with three circles 110, 114, 116 on each side 98*a*, 98*b* of the face shield member 80, with a triangular cut 118 connecting two of these circles 114, 116. In this manner, with the clip members 130, the cuts 62 preferably enable and allow the face shield member 80 to flip up and stay up (in an open configuration). These cuts 62, with the clip members 130, preferably also enable and allow the face shield member 80 to flip down and stay in a down position (in a closed configuration).

As shown in FIGS. 1-3 and 5-8, the face shield member 80 is preferably also provided with ample space 66 for one or more engravings, cuts, markings, and/or branding elements that may be provided on the sides 98*a*, 98*b* of the face shield member 80.

The face shield member 80 is preferably also formed with other cuts 62, 64 that can be used to fold and help create the enclosed bottom portion 86 of the face shield member 80, using a substantially flat plastic sheet 60*a*, 60*b*, 60*c*, 60*a*', 60*b*', 60*c*', 60*d*' as a starting material. (It should perhaps be noted, however, that the enclosed bottom portion 86 could instead, or in addition, be provided by other manufacturing processes, such as, for example, by injection molding. Preferred embodiments of the invention are broad enough to encompass such manufacturing processes.)

The clip members 130 preferably have one or more elements and/or features. For example, the clip members 130 are preferably constructed of a curved plastic and can preferably attach to the brim 46 of a cap 44, 44' and/or to the arms 56 of a user's eyeglass frames 54. Each clip member 130 is preferably formed and/or shaped to provide two "knob" members 140, 142 on its outer side portion 134, as perhaps best seen in FIGS. 10 and 13-17. The clip members 130 may preferably, but need not necessarily, be constructed from a flexible plastic material that helps to stabilize the face shield member 80 and allows it to be selectively pivoted.

As may be best appreciated from consideration of FIGS. 10, 13, 15-16, 24-26, and 28 (among others), the clip member 130 preferably has some flexibility in it, preferably enabling and/or helping enable the clip member 130 to attach to materials (e.g., hat brims 46, eyeglass frames 54) of different thicknesses.

As best seen in FIGS. 10 and 13, the clip member 130 preferably has an inner arm portion 152 that curves inward and terminates in a tip portion 156. The tip portion 156 is preferably shaped with a bulge. The bulging tip portion 156 preferably helps to attach the clip member 130 onto different materials (e.g., hat brims 46 and/or eyeglass frames 54) of different thicknesses.

The clip member 130 preferably also has an exterior facing portion 134. The exterior facing portion 134 is preferably angled, relative to the inward curve of the inner arm portion 152, in such a way that the face shield member 80 (when attached) can rest substantially parallel to the user's face, as may be best appreciated from a consideration of FIGS. 10, 13, 15-18, 25-26, and 28.

The two knob members 140, 142 preferably protrude from the exterior facing portion 134 of the clip member 130, and provide the primary mechanism to attach the face shield member 80 to the clip member 130. As perhaps best seen in FIGS. 16, 20, and 22, the two knob members 140, 142 preferably attach to and securely engage the face shield member 80 through the three holes 110, 114, 116 that are cut adjacent to the top portion 90 of the face shield member 80.

The two knob members 140, 142 preferably work, together with the holes 110, 114, 116 cut at the top portion 90 of the face shield member 80, to allow the face shield member 80 to be selectively pivoted and/or flipped up and down. The holes 110, 114, 116 (i.e., circular cuts 62) preferably provide a secure place for the knob members 140, 142 to rest, whether in the open/up configuration or in the closed/down configuration. The triangular cut portion 118 in the face shield member 80 preferably acts as a channel 118 for one of the knob members 142 to travel through, as the face shield member 80 is selectively pivoted between the open/up and closed/down configurations.

According to preferred embodiments of the invention, and as may be best appreciated from consideration of FIGS. 16, 19-22, and 24-25 the bottom knob member 142 may selectively travel from the lowest hole 114 (i.e., circular cut 62), through the triangular cut portion 118, to the connected rear upper hole 116 (i.e., circular cut 62). The top knob member 140 remains situated within the forward upper hole 110 (i.e., circular cut 62), as the remainder of the face shield member 80 selectively pivots around the top knob member 140.

The two knob members 140, 142 preferably provide stability to the face shield member 80.

In view of FIGS. 24-28, it should be appreciated that the clip members 130 preferably enable the face shield device 70 to attach to a variety of different objects of different types (e.g., hat brims 46, hats 44, 44', eyeglass frames 54, headbands, etc.), sizes and configurations. The face shield device 70 can preferably, according to the invention, be transferred to a wide variety of different user headgear 44, 44', 54 with the clip members 130 well-adapted to attach to anything that fits, e.g., hat brims 46, hats 44, 44', eyeglass frames 54, headbands, etc.

It should be understood, in view of FIGS. 27-28, that the face shield device 70 and system 70, 170 may optionally be provided with a further attachment 170 that enables the face shield member 80 to be suspended in front of the user's face, without requiring the user 40 to wear a hat or eyeglass frames. Such attachment preferably, according to the invention, attaches to the clip members 130 and affords a substantially unobstructed view of the user's entire face. The attachment 170 preferably rests on the user's ear, and has an arm 172 that extends forward to attach and securely engage the clip member 130.

In use, the selectively pivotable face shield device, system, and/or method preferably offer one or more advantages (over the prior art), including, without limitation, the following: (a) better airflow; (b) better protection; (c) better convenience, for example, perhaps at least in part, by enabling the face shield member to be selectively moved between the raised open and lowered closed configurations; (d) potentially lower environmental impact, for example, due perhaps at least in part to its relatively simple design and/or its ready ability to be reusable, e.g., in comparison to single-use face masks; (e) better transferability of the same face shield device between different objects, e.g., hat, eyeglass frames, etc.; (f) better comfort, for example, due perhaps at least in part to its relatively simple design; (g) more stylish; (h) adapted to be more easily and/or more readily cleaned; and/or (i) better and/or less obstructed view of the user and/or of surrounding environment by the user.

The invention preferably helps to reduce, minimize, or avoid risk of harm associated with noxious airborne substances.

One or more features and functionalities of the invention may preferably be offered under or in association with the applicant's distinctive CHOZEN SHIELD, FUNDAMENTAL SHIELD, and/or FUNPPE trademarks.

The invention is contemplated for use in association with noxious airborne substances. The invention, however, is not so limited. Ordinarily skilled persons, in view of the teachings and disclosures herein, may appreciate other advantageous utilities for the invention. Other embodiments, which fall within the scope of the invention, may be provided.

For example, the face shield member may be constructed (e.g., from a particular material and/or using a method of manufacture) to afford the user with solar protection, e.g., polarized against bright light and/or to provide protection against harmful ultraviolet light and/or other electromagnetic frequencies. In addition or instead, the face shield member may be cut and/or otherwise shaped—with holes, slots, and/or otherwise—to further enhance ventilation for the user. The face shield member may also or instead be provided with increased clarity and/or anti-fogging characteristics.

Additionally, the device and/or system may be otherwise constructed and/or constructed from different materials. For example, herein, it has been contemplated that the stop members may preferably be constructed of a resiliently deformable material. While, of course, the rest of the face shield may be constructed from a different material, such as, for example, the somewhat harder plastic of a hockey helmet visor. In addition or instead, the stop members could be provided on the clip member and/or the sliding knob member could be provided on the face shield. And/or, the stop members could be constructed from a somewhat more rigid material (in comparison to a resiliently deformable one), with the sliding knob member additionally or instead constructed from the resiliently deformable material.

Likewise, components of the device may be manufactured and/or molded together in a unitary one-piece construction and/or may be manufactured and/or molded apart from one another in multiple pieces for subsequent assembly with one another.

The foregoing description has been presented for the purpose of illustration and is not intended to be exhaustive or to limit the invention to the precise form disclosed.

Naturally, in view of the teachings and disclosures herein, persons having ordinary skill in the art may appreciate that alternate designs and/or embodiments of the invention may be possible (e.g., with substitution of one or more components for others, with alternate configurations of components, etc). Although some of the components, relations, configurations and/or steps according to the invention are not specifically referenced in association with one another, they may be used, and/or adapted for use, in association therewith. For example, features may be discussed herein in the context of the device, which clearly could be recast as steps of a method and/or as the interworking of a system. All of the aforementioned and various other features, steps, interworkings, structures, configurations, relationships, utilities, and/or the like (any of which may be depicted and/or based hereon) may be, but are not necessarily, incorporated into and/or achieved by the invention. Any one or more of the aforementioned features, steps, interworkings, structures, configurations, relationships, utilities and the like may be implemented in and/or by the invention, on their own, and/or without reference, regard or likewise implementation of any of the other aforementioned features, steps, interworkings, structures, configurations, relationships, utilities and the like, in various permutations and combinations, as will be readily apparent to those skilled in the art, without departing from the pith, marrow, and spirit of the disclosed invention.

Other modifications and alterations may be used in the design, manufacture, and/or implementation of other embodiments according to the present invention without departing from the spirit and scope of the invention, which is limited only by the claims hereof.

The invention claimed is:

1. A selectively pivotable face shield device for use with user headgear and for physically blocking noxious airborne substances, the device comprising:

(a) a face shield member that has a front shield portion and side shield portions, and is shaped to define stop members constructed of a resiliently deformable material; wherein the front shield portion is constructed of a substantially optically clear material; and wherein each of the side shield portions is shaped to define a pivot hole therethrough; and (b) clip members, each having a clipping portion and a pivot knob member that securely engages and extends outward from the clipping portion;

wherein the pivot knob member of each of said clip members extends, in secure and selectively pivotable engagement, through the pivot hole in a respective one of said side shield portions, such that the face shield member securely and pivotably engages the clip members;

wherein the clipping portion of each of said clip members is selectively securable, in use, to the headgear, such that the face shield member is pivotably secured to the headgear for selective pivoting between an open configuration and a closed configuration that physically blocks noxious airborne substances;

wherein the clipping portion of each of said clip members comprises an outer arm portion, an inner arm portion, and a bottom portion that securely engages the outer arm portion and the inner arm portion;

wherein, in use, the headgear is secured between the outer arm portion and the inner arm portion; and wherein the pivot knob member securely engages and extends outward from the outer arm portion;

wherein the face shield member is gravity-biased towards the closed configuration;

wherein the face shield member is selectively pivotable against said gravity-biasing away from the closed configuration, past the stop members, into the open configuration;

wherein, in the open configuration, the shaping of the stop members from the resiliently deformable material is sufficient to withstand said gravity-biasing, such that the stop members then maintain the face shield member in the open configuration;

and wherein selective resilient deformation of the stop members permits pivoting of the face shield member away from the open configuration towards the closed configuration.

2. The device of claim 1, wherein the face shield member is further shaped to define a wide hole and a raised hole through each respective one of the side shield portions; wherein each of the stop members comprises a stop channel that is also shaped through said respective one of the side shield portions, and extends from the wide hole to the raised hole; wherein the stop channel has a narrowing as it extends from the wide hole to the raised hole; wherein each of the clip members comprises a sliding knob member that securely engages and extends outward from the clipping portion; wherein the sliding knob member extends through the wide hole, the stop channel, and the raised hole in secure sliding engagement; wherein, in the closed configuration, the sliding knob member rests in the wide hole; wherein, when the face shield member is selectively pivoted away from the closed configuration, the sliding knob member slides through the stop channel and into the raised hole in the open configuration; wherein, in the open configuration, the aforesaid narrowing of the stop channel obstructs the sliding knob member and keeps the sliding knob member in the raised hole; and wherein selective resilient deformation of the stop channel permits sliding of the sliding knob member away from the raised hole, through the stop channel, towards the wide hole.

3. The device according to claim 1, wherein the clipping portion of each of said clip members is selectively removable from the user headgear.

4. The device according to claim 1, wherein the inner arm portion has a bulging tip portion, the outer arm portion has an inner surface, and in use, the headgear is secured between the inner surface and the bulging tip portion; and wherein the outer arm portion has an exterior facing portion that is angled relative to the inner surface such that, in use, the face shield member is adapted to hang substantially parallel to the user's face.

5. The device according to claim 1, wherein the face shield member has an enclosing bottom shield portion that is adapted to extend rearward from the front shield portion under the user's chin.

6. The device according to claim 5, wherein the bottom shield portion comprises a bottom filter member that permits passage of air therethrough and physically blocks noxious airborne substances.

7. The device according to claim 5, further comprising one or more filter skirt inserts that securely engage the face shield member, and are adapted to extend between the face shield member and the user, while permitting passage of air therethrough and physically blocking noxious airborne substances.

8. The device according to claim 5, wherein the face shield member is formed from a substantially flat plastic sheet.

9. The device according claim 8, wherein the sheet is folded into a folded configuration to form the face shield member.

10. The device according claim 9, wherein the sheet is shaped to define one or more fold notches and mating tongues; and wherein the one or more fold notches securely engage the mating tongues to maintain the face shield member in the folded configuration.

11. The device according to claim 1 wherein the substantially optically clear material of the front shield portion provides a substantially unobstructed frontal view of the user.

12. The device according to claim 1 adapted for use with a baseball cap, a visor-style hat, and/or eyeglass frames as the user headgear, with each said clipping portion secured to a brim of the baseball cap and/or of the visor-style hat, and/or to an arm of the eyeglass frames.

13. A selectively pivotable face shield system for physically blocking noxious airborne substances, the system comprising:

(a) a headgear adapted to be worn on a user's head;

(b) a face shield member that has a front shield portion and side shield portions, and is shaped to define stop members constructed of a resiliently deformable material; wherein the front shield portion is constructed of a substantially optically clear material;

and wherein each of the side shield portions is shaped to define a pivot hole therethrough; and (c) clip members, each having a clipping portion and a pivot knob member that securely engages and extends outward from the clipping portion;

wherein the pivot knob member of each of said clip members extends, in secure and selectively pivotable engagement, through the pivot hole in a respective one of said side shield portions, such that the face shield member securely and pivotably engages the clip members;

wherein, in use, the clipping portion of each of said clip members is secured to the headgear, such that the face shield member is pivotably secured to the headgear for selective pivoting between an open configuration and a closed configuration that physically blocks noxious airborne substances;

wherein the clipping portion of each of said clip members comprises an outer arm portion, an inner arm portion, and a bottom portion that securely engages the outer arm portion and the inner arm portion; wherein, in use, the headgear is secured between the outer arm portion and the inner arm portion; and wherein the pivot knob member securely engages and extends outward from the outer arm portion;

wherein the face shield member is gravity-biased towards the closed configuration;

wherein the face shield member is selectively pivotable against said gravity-biasing away from the closed configuration, past the stop members, into the open configuration;

wherein, in the open configuration, the shaping of the stop members from the resiliently deformable material is sufficient to withstand said gravity-biasing, such that the stop members then maintain the face shield member in the open configuration;

and wherein selective resilient deformation of the stop members permits pivoting of the face shield member away from the open configuration towards the closed configuration.

14. The system according to claim 13, wherein the headgear comprises two arm portions, with each said clipping portion secured to a respective one of the arm portions.

15. The system according to claim 14, wherein the headgear further comprises two earpiece portions adapted to be worn on the user's ears; wherein each of the arm portions securely engages and extends forward from a respective one of the earpiece portions.

16. A method of forming the face shield member of the device according to claim 1 from a substantially optically clear, substantially flat, deformable plastic sheet, for use in physically blocking noxious airborne substances, the method comprising steps of:

(a) cutting the plastic sheet to define one or more fold notches and mating tongues;

(b) folding the plastic sheet into a folded configuration to form the face shield member, such that the face shield member has the front shield portion, the side shield portions, and an enclosing bottom shield portion that extends rearward from the front shield portion, with the one or more fold notches securely engaging the mating tongues to maintain the face shield member in the folded configuration;

and (c) securely attaching the face shield member to the headgear by one or more clip members, with the headgear adapted to be worn by a user; whereby, in use, the enclosing bottom shield portion is adapted to extend under the user's chin, and the face shield member physically blocks noxious airborne substances.

* * * * *